US010842226B2

(12) United States Patent
Langvin et al.

(10) Patent No.: US 10,842,226 B2
(45) **Date of Patent: *Nov. 24, 2020**

(54) ARTICLE OF FOOTWEAR WITH AN ADAPTIVE FLUID SYSTEM

(71) Applicant: NIKE, Inc., Beaverton, OR (US)

(72) Inventors: Elizabeth Langvin, Sherwood, OR (US); James Molyneux, Portland, OR (US); Lee D. Peyton, Tigard, OR (US); Ty A. Ransom, Portland, OR (US); Nicola J. Reynolds, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 18 days.

This patent is subject to a terminal disclaimer.

(21) Appl. No.: 16/296,387

(22) Filed: Mar. 8, 2019

(65) Prior Publication Data

US 2019/0269201 A1 Sep. 5, 2019

Related U.S. Application Data

(60) Continuation of application No. 15/399,194, filed on Jan. 5, 2017, now Pat. No. 10,258,105, which is a (Continued)

(51) Int. Cl.
*A43B 13/20* (2006.01)
*A43B 21/28* (2006.01)
(Continued)

(52) U.S. Cl.
CPC ..... *A43B 13/203* (2013.01); *A43B 13/186* (2013.01); *A43B 13/189* (2013.01);
(Continued)

(58) Field of Classification Search
CPC ..... A43B 13/20; A43B 13/203; A43B 13/206; A43B 21/28; A43B 21/285
(Continued)

(56) References Cited

U.S. PATENT DOCUMENTS 510,504 A 12/1893 Foster
572,887 A 12/1896 Gallagher
(Continued)

FOREIGN PATENT DOCUMENTS

CN 1086693 A 5/1994
CN 101600409 A 12/2009
(Continued)

OTHER PUBLICATIONS

Response to Office Action filed Mar. 18, 2014, in U.S. Appl. No. 13/081,069.
(Continued)

*Primary Examiner* — Marie D Bays
(74) *Attorney, Agent, or Firm* — Banner & Witcoff, Ltd.

(57) ABSTRACT

An adaptive fluid system for an article of footwear is disclosed. The adaptive fluid system includes a fluid chamber that provides cushioning and shock absorption for a foot. The adaptive fluid system includes an adjustable pressure regulating valve that may be used to control the pressure of the fluid chamber. The adaptive fluid system includes a valve that prevents fluid from escaping from a fluid chamber during use.

6 Claims, 14 Drawing Sheets

Related U.S. Application Data continuation of application No. 14/480,892, filed on Sep. 9, 2014, now Pat. No. 9,560,894, which is a division of application No. 13/081,058, filed on Apr. 6, 2011, now Pat. No. 8,857,076.

(51) Int. Cl.
*A43B 23/02* (2006.01)
*A43B 13/18* (2006.01)

(52) U.S. Cl.
CPC ..... *A43B 13/20* (2013.01); *A43B 13/206* (2013.01); *A43B 21/28* (2013.01); *A43B 23/029* (2013.01)

(58) Field of Classification Search
USPC ..... 36/29, 35 B
See application file for complete search history.

(56) References Cited

U.S. PATENT DOCUMENTS 586,166 A 7/1897 Bascom
1,010,187 A 11/1911 Scott
1,011,460 A 12/1911 Maddocks
1,069,001 A 7/1913 Guy
1,304,915 A 5/1919 Spinney
1,498,838 A 6/1924 Harrison, Jr.
1,557,947 A 10/1925 Stewart
1,838,811 A 12/1931 Doran
1,869,051 A 7/1932 Davis
1,915,899 A 6/1933 Monro et al.
2,007,803 A 7/1935 Kelly
2,109,180 A 2/1938 Mohun
3,255,774 A 6/1966 Gallagher et al.
3,721,265 A 3/1973 Hoffland
3,910,305 A 10/1975 Hughes
4,129,951 A 12/1978 Petrosky
4,183,156 A 1/1980 Rudy
4,219,945 A 9/1980 Rudy
4,237,625 A 12/1980 Cole et al.
4,358,902 A 11/1982 Cole et al.
4,361,969 A 12/1982 Vermonet
4,657,716 A 4/1987 Schmidt
4,670,995 A 6/1987 Huang
4,712,316 A 12/1987 Baggio
4,722,131 A 2/1988 Huang
4,763,426 A 8/1988 Polus et al.
4,776,766 A 10/1988 Brent
4,856,208 A 8/1989 Zaccaro
4,873,774 A 10/1989 Lafever
4,887,367 A 12/1989 Mackness et al.
4,912,861 A 4/1990 Huang
4,936,029 A 6/1990 Rudy
4,991,317 A 2/1991 Lakic
5,025,575 A 6/1991 Lakic
5,040,563 A 8/1991 Wood
5,042,176 A 8/1991 Rudy
5,083,361 A 1/1992 Rudy
5,113,599 A 5/1992 Cohen et al.
5,144,708 A 9/1992 Pekar
5,158,767 A 10/1992 Cohen et al.
5,179,792 A 1/1993 Brantingham
5,193,246 A 3/1993 Huang
5,199,191 A 4/1993 Moumdjian
5,222,312 A 6/1993 Doyle
5,224,278 A 7/1993 Jeon
5,228,156 A 7/1993 Wang
5,238,231 A 8/1993 Huang
5,253,435 A 10/1993 Auger et al.
5,257,470 A 11/1993 Auger et al.
5,295,313 A 3/1994 Lee
5,335,382 A 8/1994 Huang
5,351,710 A 10/1994 Phillips
5,355,552 A 10/1994 Huang
5,384,977 A 1/1995 Chee
5,406,661 A 4/1995 Pekar
5,558,395 A 9/1996 Huang
5,564,143 A 10/1996 Pekar et al.
5,588,227 A 12/1996 Goldston et al.
5,590,696 A 1/1997 Phillips et al.
5,598,645 A 2/1997 Kaiser
5,669,161 A 9/1997 Huang
5,713,141 A 2/1998 Mitchell et al.
5,740,619 A 4/1998 Broder
5,741,568 A 4/1998 Rudy
5,794,361 A 8/1998 Sadler
5,802,738 A 9/1998 Ferniani
5,802,739 A 9/1998 Potter et al.
5,813,142 A 9/1998 Demon
5,830,553 A 11/1998 Huang
5,846,063 A 12/1998 Lakic
5,902,660 A 5/1999 Huang
5,907,911 A 6/1999 Huang
5,918,383 A 7/1999 Chee
5,925,306 A 7/1999 Huang
5,937,462 A 8/1999 Huang
5,952,065 A 9/1999 Mitchell et al.
5,979,078 A 11/1999 McLaughlin
5,987,779 A 11/1999 Litchfield et al.
5,996,253 A 12/1999 Spector
6,013,340 A 1/2000 Bonk et al.
6,014,823 A 1/2000 Lakic
6,027,683 A 2/2000 Huang
6,065,150 A 5/2000 Huang
6,082,025 A 7/2000 Bonk et al.
6,119,371 A 9/2000 Goodwin et al.
6,127,010 A 10/2000 Rudy
6,127,026 A 10/2000 Bonk et al.
6,128,837 A 10/2000 Huang
6,134,812 A 10/2000 Voss
6,161,240 A 12/2000 Huang
6,170,173 B1 1/2001 Caston
6,203,868 B1 3/2001 Bonk et al.
6,282,815 B1 9/2001 Caston
6,298,499 B1 10/2001 Huang
6,305,102 B1 10/2001 Doyle
6,314,663 B1 11/2001 Saldana
6,321,465 B1 11/2001 Bonk et al.
6,391,405 B1 5/2002 Bonk et al.
6,409,487 B1 6/2002 Baek
6,428,865 B1 8/2002 Huang
6,430,843 B1 8/2002 Potter et al.
6,460,197 B2 10/2002 Huang
6,510,624 B1 1/2003 Lakic
6,519,873 B1 2/2003 Buttigieg
6,537,639 B1 3/2003 Huang
6,553,691 B2 4/2003 Huang
6,557,271 B1 5/2003 Weaver, III
6,571,490 B2 6/2003 Tawney et al.
6,585,669 B2 7/2003 Manor et al.
6,725,573 B2 4/2004 Doyle
6,730,379 B2 5/2004 Bonk et al.
6,773,785 B1 8/2004 Huang
6,782,640 B2 8/2004 Westin
6,785,985 B2 9/2004 Marvin et al.
6,865,825 B2 3/2005 Bailey, Sr. et al.
6,889,451 B2 5/2005 Passke et al.
6,915,594 B2 7/2005 Kim
6,971,193 B1 12/2005 Potter et al.
6,976,321 B1 12/2005 Lakic
6,988,329 B2 1/2006 Marvin et al.
7,017,285 B2 3/2006 Lakic
7,047,670 B2 5/2006 Marvin et al.
7,051,456 B2 5/2006 Swigart et al.
7,070,845 B2 7/2006 Thomas et al.
7,107,706 B1 9/2006 Bailey, Sr. et al.
7,131,218 B2 11/2006 Schindler
7,152,625 B2 12/2006 Marvin et al.
7,171,765 B2 2/2007 Lo
7,204,041 B1 4/2007 Bailey, Sr. et al.
7,244,483 B2 7/2007 Tawney et al.
7,254,909 B2 8/2007 Ungari
7,278,445 B2 10/2007 Marvin et al.
7,337,560 B2 3/2008 Marvin et al.

(56) References Cited

U.S. PATENT DOCUMENTS

| | | | | |
|---|---|---|---|---|
| 7,340,851 | B2 | 3/2008 | Litchfield et al. | |
| 7,383,648 | B1 | 6/2008 | Litchfield et al. | |
| 7,395,614 | B1 | 7/2008 | Bailey, Sr. et al. | |
| 7,395,615 | B2 | 7/2008 | Lee | |
| 7,409,779 | B2 | 8/2008 | Dojan et al. | |
| 7,409,780 | B2 | 8/2008 | Marvin et al. | |
| 7,448,150 | B1 | 11/2008 | Davis et al. | |
| 7,451,554 | B2 | 11/2008 | Hazenberg et al. | |
| 7,451,555 | B1 | 11/2008 | Lakic | |
| 7,478,488 | B1 | 1/2009 | Davis et al. | |
| 7,578,074 | B2 | 8/2009 | Ridinger | |
| 7,784,196 | B1 | 8/2010 | Christensen et al. | |
| 8,037,623 | B2 | 10/2011 | Passke et al. | |
| 8,857,076 | B2 | 10/2014 | Langvin et al. | |
| 9,049,902 | B2 | 6/2015 | Baker et al. | |
| 9,560,894 | B2 * | 2/2017 | Langvin | A43B 13/203 |
| 10,258,105 | B2 * | 4/2019 | Langvin | A43B 13/203 |
| 2002/0164257 | A1 | 11/2002 | Baek | |
| 2002/0194747 | A1 | 12/2002 | Passke et al. | |
| 2003/0098118 | A1 | 5/2003 | Rapaport | |
| 2004/0010939 | A1 | 1/2004 | Liu et al. | |
| 2004/0088882 | A1 | 5/2004 | Buttigieg | |
| 2005/0039346 | A1 | 2/2005 | Thomas et al. | |
| 2005/0097777 | A1 | 5/2005 | Goodwin | |
| 2005/0183287 | A1 | 8/2005 | Schindler | |
| 2005/0241185 | A1 | 11/2005 | Flood et al. | |
| 2006/0174518 | A1 | 8/2006 | Fogarty et al. | |
| 2006/0196081 | A1 | 9/2006 | Lee | |
| 2006/0225304 | A1 | 10/2006 | Goodwin | |
| 2008/0163517 | A1 | 7/2008 | Chen | |
| 2008/0222916 | A1 | 9/2008 | Jin | |
| 2009/0288312 | A1 | 11/2009 | Dua | |
| 2009/0288313 | A1 | 11/2009 | Rapaport et al. | |
| 2010/0242303 | A1 | 9/2010 | Callahan et al. | |
| 2011/0067264 | A1 | 3/2011 | Doyle | |
| 2015/0157481 | A1 | 6/2015 | Whitaker et al. | |
| 2015/0351488 | A1 | 12/2015 | Davis et al. | |
| 2016/0010637 | A1 | 1/2016 | Chuang | |
| 2016/0076527 | A1 | 3/2016 | Kennedy Lageson et al. | |

FOREIGN PATENT DOCUMENTS

| | | | |
|---|---|---|---|
| CN | 101849724 | A | 10/2010 |
| CN | 201700496 | U | 1/2011 |
| DE | 2855268 | A1 | 7/1980 |
| FR | 2801174 | A1 | 5/2001 |
| WO | 8703789 | A1 | 7/1987 |
| WO | 9119430 | A1 | 12/1991 |
| WO | 9314659 | A1 | 8/1993 |
| WO | 0178539 | A2 | 10/2001 |
| WO | 200178539 | A2 | 10/2001 |
| WO | 2008051165 | A1 | 5/2008 |
| WO | 2009027941 | A2 | 3/2009 |

OTHER PUBLICATIONS

Observations and Voluntary Amendments filed May 6, 2014, in Chinese Patent Application No. 201280015874.3 and English translation thereof.
Response to Written Opinion filed Apr. 28, 2014, in European Patent Application No. 12721619.0.
Response to Written Opinion filed Apr. 28, 2014, in European Patent Application No. 12719521.2.
Response to Written Opinion filed Apr. 8, 2014, in European Patent Application No. 12718765.6.
Response to Office Action filed May 12, 2014, in U.S. Appl. No. 13/081,079.
Observations and Voluntary Amendments filed Mar. 31, 2014, in Chinese Patent Application No. 201280017035.5, with English translation of the amended claims.
Observations and Voluntary Amendments filed May 16, 2014, in Chinese Patent Application No. 201280015447.5, and English translation thereof.
Amendment filed Aug. 19, 2014, in U.S. Appl. No. 13/081,091.
International Preliminary Report on Patentability (including Written Opinion of the ISA) dated Oct. 17, 2013, in International Application No. PCT/US2012/030721.
International Preliminary Report on Patentability (including Written Opinion of the ISA) dated Oct. 17, 2013, in International Application No. PCT/US2012/030724.
Oct. 26, 2012—(WO) ISR & WO—App. No. PCT/US12/030718.
International Search Report and Written Opinion dated Oct. 19, 2012, in International Application No. PCT/US2012/030721.
International Search Report and Written Opinion dated Oct. 22, 2012, in International Application No. PCT/US2012/030724.
International Search Report and Written Opinion dated Oct. 25, 2012, in International Application No. PCT/US2012/030726.
International Preliminary Report on Patentability (including Written Opinion of the ISA) dated Oct. 17, 2013, in International Application No. PCT/US2012/030726.
Office Action in EP12718765.6 dated Jan. 22, 2016.
International Preliminary Report on Patentability (including Written Opinion of the ISA) dated Oct. 17, 2013 in International Application No. PCT/US2012/030718.
The First Office Action in CN201280015447.5 dated Jul. 7, 2015, with Search Report and English translation.
Office Action in CN201610424402.3 dated Jun. 28, 2017.
Communication in EP17156445.3 dated Jul. 10, 2017.
May 2, 2012—(CN) Second Office Action—App 201610424402.3.
Oct. 30, 2018—(CN) Notice of Allowance—App 201610424402.3.

* cited by examiner

ARTICLE OF FOOTWEAR WITH AN ADAPTIVE FLUID SYSTEM

CROSS-REFERENCE TO RELATED APPLICATIONS

This application is a continuation of U.S. patent application Ser. No. 15/399,194, filed Jan. 5, 2017 (now allowed), which is a continuation of U.S. patent application Ser. No. 14/480,892, filed Sep. 9, 2014, (now U.S. Pat. No. 9,560,894) which is a division of U.S. patent application Ser. No. 13/081,058, filed Apr. 6, 2011 (now U.S. Pat. No. 8,857,076). Application Ser. No. 15/399,194, application Ser. No. 14/480,892 and application Ser. No. 13/081,058, in their entireties, are incorporated by reference herein.

BACKGROUND

The present embodiments relate generally to an article of footwear, and in particular to an article of footwear with a system.

Articles associated with cushioning have been previously proposed. Some use an inlet valve and an outlet valve. Some use a relief valve to release compressed air into the atmosphere.

SUMMARY

In one aspect, an adaptive fluid system for an article of footwear comprises: a fluid chamber disposed in a portion of the article of footwear; an intake valve configured to receive fluid from an external pump; an adjustable pressure regulating valve disposed in the article of footwear, the adjustable pressure regulating valve having an adjustable maximum pressure setting; the adjustable pressure regulating valve in fluid communication with the intake valve; and where a fluid inlet of the fluid chamber is in fluid communication with the adjustable pressure regulating valve and wherein the fluid inlet is disposed downstream of the adjustable pressure regulating valve.

In another aspect, an adaptive fluid system for an article of footwear comprises: a fluid chamber disposed in a portion of the article of footwear; an adjustable pressure regulating valve, the adjustable pressure regulating valve having an adjustable maximum pressure setting; a flow valve including a fluid inlet in fluid communication with the adjustable pressure regulating valve and the flow valve including a fluid outlet in fluid communication with the fluid chamber; the flow valve having an open position in which the fluid inlet is in fluid communication with the fluid outlet and a closed position in which fluid communication is prevented between the fluid inlet and the fluid outlet; the flow valve being disposed downstream of the adjustable pressure regulating valve and the fluid chamber being disposed downstream of the flow valve; and where the adjustable pressure regulating valve is in fluid communication with the fluid chamber when the flow valve is in the open position and wherein fluid communication between the adjustable pressure regulating valve and the fluid chamber is prevented when the flow valve is closed.

In another aspect a method of operating an adaptive fluid system in an article of footwear comprises: selecting a maximum pressure setting for an adjustable pressure regulating valve disposed in the article of footwear; opening a flow valve in the article of footwear; supplying fluid to an intake valve of the article of footwear to inflate a fluid chamber in the article of footwear; and closing the flow valve.

In another aspect, an adaptive fluid system for an article of footwear comprises: a fluid chamber disposed in a portion of the article of footwear; a pump configured to deliver fluid to the fluid chamber; an adjustable pressure regulating valve disposed in the article of footwear, the adjustable pressure regulating valve having an adjustable maximum pressure setting; the adjustable pressure regulating valve including a fluid inlet disposed downstream of the pump and a fluid outlet disposed upstream of the fluid chamber; a one way valve disposed between the fluid outlet of the pressure regulating valve and a fluid inlet of the fluid chamber; and where the one way valve allows fluid to flow between the adjustable pressure regulating valve to the fluid chamber and where the one way valve prevents fluid flow from the fluid chamber to the adjustable pressure regulating valve.

In another aspect, an adaptive fluid system for an article of footwear comprises: a fluid chamber disposed in a portion of the article of footwear; an internal pump configured to deliver fluid to the fluid chamber, the internal pump being disposed in the article of footwear; an adjustable pressure regulating valve disposed in the article of footwear, the adjustable pressure regulating valve having an adjustable maximum pressure setting; the adjustable pressure regulating valve including a fluid inlet disposed downstream of the internal pump and a fluid outlet disposed upstream of the fluid chamber; a one way valve disposed between the internal pump and the fluid inlet of the adjustable pressure regulating valve; and where the one way valve allows fluid to flow from the internal pump to the adjustable pressure regulating valve and wherein the one way valve prevents fluid from flowing from the adjustable pressure regulating valve to the internal pump.

In another aspect, an adaptive fluid system for an article of footwear comprises a fluid chamber disposed in a sole structure of the article of footwear; an internal pump configured to deliver fluid to the fluid chamber; an adjustable pressure regulating valve disposed in the article of footwear, the adjustable pressure regulating valve having an adjustable maximum pressure setting; the adjustable pressure regulating valve including a fluid inlet disposed downstream of the pump and a fluid outlet disposed upstream of the fluid chamber; and where a pressure of the fluid chamber immediately preceding a compression of the sole structure is substantially equal to a pressure of the fluid chamber immediately following a compression of the sole structure.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
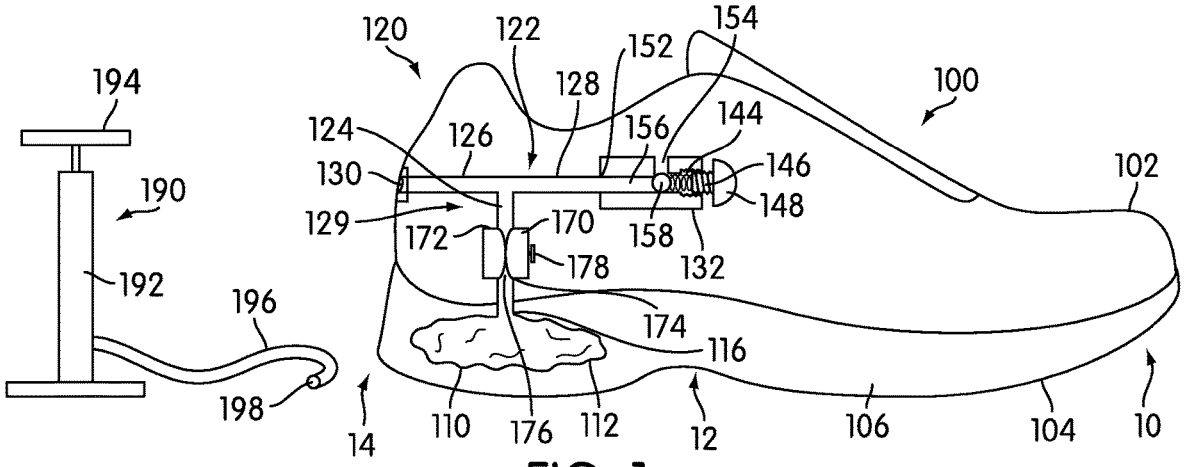
FIG. 1 is schematic view of an embodiment of an adaptive fluid system for an article of footwear.

FIG. 1 illustrates a schematic view of an exemplary embodiment of article of footwear 100. For clarity, the following detailed description discusses an exemplary embodiment, in the form of a running shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Article of footwear 100 may be configured with upper 102 and sole structure 104, also referred to as sole 104. In some cases, sole structure 104 may be provided with midsole 106. For purposes of clarity, the current embodiment illustrates some components of article 100 but may not illustrate all components of article 100.

An article of footwear can include provisions for enhancing the comfort of a user. In some embodiments, an article can include one or more cushioning devices. For example, in some cases, an article may be provided with one or more fluid chambers. Fluid chambers can be used in the sole of an article or in the upper. Fluid chambers may help reduce the weight of an article. Also, fluid chambers may help provide enhanced cushioning for an article. For example, fluid chambers used in a sole of an article can help absorb shocks applied as an article contacts the ground during walking, running, jumping or other activities.

In the current embodiment, article of footwear 100 may include fluid chamber 110. Fluid chamber 110 can be any kind of chamber that is configured to receive a fluid of some kind. In some cases, fluid chamber 110 can be configured to receive a gas including, but not limited to: air, hydrogen, helium, nitrogen or any other type of gas including a combination of any gases. In other cases, fluid chamber 110 can be configured to receive a liquid, such as water or any other type of liquid including a combination of liquids. In an exemplary embodiment, a fluid used to fill fluid chamber 110 can be selected according to desired properties such as compressibility. For example, in cases where it is desirable for fluid chamber 110 to be substantially incompressible, a liquid such as water could be used to fill fluid chamber 110. Also, in cases where it is desirable for fluid chamber 110 to be partially compressible, a gas such as air could be used to fill fluid chamber 110.

Fluid chamber 110 may be disposed in any portion of article 100. In the current embodiment, fluid chamber 110 is disposed in sole structure 104 of article 100. In particular, in some cases, fluid chamber 110 may be disposed in midsole 106 of sole structure 104. In other cases, however, fluid chamber 110 could be disposed in an outsole or insole of sole structure 104. In some cases, fluid chamber 110 may be enclosed within midsole 106. In other cases, fluid chamber 110 could be partially enclosed within midsole 106, with some portions extending above or below midsole 106. In still other cases, some portions of fluid chamber 110 could be flush with an upper surface and/or a lower surface of midsole 106.

In the current embodiment, fluid chamber 110 may be disposed in heel portion 14 of article 100. However, in other embodiments, fluid chamber 110 could be disposed in forefoot portion 10 or midfoot portion 12. In still other embodiments, fluid chamber 110 could be configured to extend through multiple portions of article 100 including any of forefoot portion 10, midfoot portion 12 and/or heel portion 14.

In other embodiments, fluid chamber 110 could be disposed in any other portion of article 100. In some cases, for example, fluid chamber 110 could be disposed in any portion of upper 102. Furthermore, in still other cases, fluid chamber 110 could be disposed in any other footwear component that may be used with article 100, including, but not limited to: insoles, lasting boards, liners as well as any other components associated with an article of footwear.

Fluid chamber 110 may include outer lining 112 that encloses fluid filled chamber 110. Outer lining 112 may be substantially impermeable to fluid so that fluid cannot escape from fluid chamber 110. Fluid chamber 110 may further include fluid inlet 116 that is disposed on outer lining 112 and that provides fluid communication to fluid chamber 110. In some cases, fluid inlet 116 may serve as both an inlet and an outlet for fluid moving into and out of fluid chamber 110, respectively.

It will be understood that while the current embodiment comprises a fluid chamber formed from an outer lining in other embodiments a fluid chamber could be formed in any other manner. For example, in another embodiment, a fluid chamber may comprise a hollow cavity in a midsole. In other words, a fluid chamber may be integrally formed with a portion of a sole structure, rather than embedded within the sole structure.

Generally, fluid chamber 110 can have any size and geometry. Examples of some possible geometries include, but are not limited to: box-like shapes, hemispherical shapes, regular three dimensional geometries, irregular three dimensional geometries as well as any other kinds of geometries. Furthermore, in other embodiments, article 100 can be configured with multiple fluid chambers, rather than a single fluid chamber. In other embodiments, two or more fluid chambers could be used.

Generally, outer lining 112 of fluid chamber 110 could be constructed of any materials including any barrier materials that are substantially impermeable to fluid. Such barrier materials may include, for example, alternating layers of thermoplastic polyurethane and ethylene-vinyl alcohol copolymer, as disclosed in U.S. Pat. Nos. 5,713,141 and 5,952,065 to Mitchell et al. A variation upon this material wherein the center layer is formed of ethylene-vinyl alcohol copolymer, the two layers adjacent to the center layer are formed of thermoplastic polyurethane, and the outer layers are formed of a regrind material of thermoplastic polyurethane and ethylene-vinyl alcohol copolymer, which may also be utilized. Another suitable material is a flexible microlayer material that includes alternating layers of a gas barrier material and an elastomeric material, as disclosed in U.S. Pat. Nos. 6,082,025 and 6,127,026 to Bonk et al.

An article can include provisions for adjusting the pressure inside of a fluid chamber. In some cases, an article can include an adaptive fluid system that allows for the pressure of a fluid chamber to be adjusted by a user. An adaptive fluid system may include a fluid chamber as well as various components for receiving fluid inside an article, transmitting fluid through portions of the article and for otherwise controlling fluid within the article in any manner.

Article 100 can include adaptive fluid system 120. Adaptive fluid system 120 may include fluid chamber 110 as well as additional components for adjusting the pressure of a fluid within fluid chamber 110. In this embodiment, adaptive fluid system 120 may include fluid line 122 for communicating fluid through article 100. Fluid line 122 may be any type of line or conduit configured to transmit fluid from one location to another. In some cases, fluid line 122 could be a flexible tube or hose of some kind. In other cases, fluid line 122 could comprise piping of some kind. In still other cases, fluid line 122 could comprise any other type of conduit for transporting fluids.

Adaptive fluid system 120 may include one or more valves that facilitate the communication of fluid through article 100. In the current embodiment, adaptive fluid system 120 may include intake valve 130 that provides fluid communication between fluid line 122 and an external pump of some kind. Intake valve 130 can be any type of valve that provides fluid communication to fluid line 122 upon engagement with an external pump or similar device. For example, in some cases, intake valve 130 may comprise a valve stem including, but not limited to: a Schrader valve, a Presta valve, a Dunlop valve as well as any other type of valve. In other cases, intake valve 130 could be any other type of valve known in the art.

An adaptive fluid system can include provisions for limiting the maximum pressure within the fluid system or within portions of the fluid system. In some cases, an adaptive fluid system may include an adjustable pressure regulating valve. In an exemplary embodiment, an adjustable pressure regulating valve may be disposed within an article of footwear.

For purposes of describing an adaptive fluid system, the term "downstream" as used throughout this detailed description and in the claims may refer to the normal direction of fluid flow. Also, the term "upstream" as used throughout this detailed description and in the claims refers to a direction opposing the normal direction of fluid flow. Moreover, these terms may be used to describe the relative locations of two or more components in an adaptive fluid system. For example, in embodiments comprising a pump and a fluid chamber, the fluid chamber is disposed downstream of the pump, since fluid normally flows from the pump to the fluid chamber. Also, the pump may be disposed upstream of the fluid chamber.

Adaptive fluid system 120 may include adjustable pressure regulating valve 132 that helps to limit the maximum pressure within fluid line 122. Adjustable pressure regulating valves are known in the art. In one embodiment, adjustable pressure regulating valve 132 may comprise a ball and spring type regulating valve. In this case, adjustable pressure regulating valve 132 includes fluid inlet 152 and fluid outlet 154, which are connected by way of first passage 156. In addition, adjustable pressure regulating valve 132 includes ball 158 that is disposed against spring 144. Also, spring 144 is disposed against screw 146 of adjustment knob 148. If the pressure within fluid line 122 is raised above a predetermined threshold, spring 144 is compressed so that ball 158 is no longer disposed between fluid inlet 152 and fluid outlet 154. In this situation, fluid can escape from fluid outlet 154, which reduces with pressure within fluid line 122 until the pressure is below the predetermined threshold. At this point, ball 158 may return to a position that blocks fluid communication with fluid outlet 154. Furthermore, by turning adjustment knob 148, the tension of spring 144 may be adjusted, which increases or decreases the amount of pressure required to move ball 158. Although an adjustment knob is used in the current embodiment, other embodiments could include any types of buttons, switches, dials or other means for adjusting an adjustable pressure regulating valve.

Adjustable pressure regulating valve 132 may be associated with a maximum pressure setting. The term "maximum pressure setting" as used throughout this detailed description and in the claims refers to a pressure above which an adjustable pressure regulating valve may open and allow fluid to escape from a portion of a fluid system. In other words, the maximum pressure setting is associated with a pressure which cannot be substantially exceeded by a fluid system due to the operation of an adjustable pressure regulating valve.

It should be understood that the current embodiment is only intended to be exemplary of one possible configuration for an adjustable pressure regulating valve. In other embodiments, an adjustable pressure regulating valve can have any other configuration. In particular, the embodiments are not limited to spring and ball type pressure regulating valves. Furthermore, while the current embodiment includes a single fluid inlet and a single fluid outlet, in other embodiments, an adjustable pressure regulating valve could include multiple fluid inlets and/or outlets. Still further, while the current embodiment uses a single adjustable pressure regulating valve, other embodiments could make use of multiple adjustable pressure regulating valves.

Adaptive fluid system 120 may include flow valve 170. In some cases, flow valve 170 may be a flow/no-flow flow valve, or an on/off valve that can be manually controlled. Flow valve 170 could be any type of valve including, but not limited to: a ball valve, a gate valve as well as any other kind of valve. In the current embodiment, flow valve 170 includes fluid inlet 172 and fluid outlet 174 that are further connected by fluid passage 176. In addition, flow valve 170 comprises switch 178 that can be used to open and close fluid passage 176. Flow valve 170 may have an open position in which fluid inlet 172 and fluid outlet 174 are in fluid communication. Flow valve 170 may also have a closed position in which fluid inlet 172 and fluid outlet 174 are not in fluid communication. For purposes of clarity, the opening and closing of flow valve 170 is shown schematically in these embodiments and can be accomplished in any manner in other embodiments. Although the current embodiment uses a switch for opening and closing a flow valve, in other embodiments, any other kinds of buttons, knobs, dials as well as any other means for operating a flow valve between an open position and a closed position can be used.

The valves discussed above may be configured in various arrangements within article 100. In the current embodiment, fluid line 122 may comprise first portion 124, second portion 126 and third portion 128 that all connect at intersection 129. First portion 124 may be connected directly to fluid inlet 116 of fluid chamber 110. Second portion 126 may be connected directly to intake valve 130. In addition, flow valve 170 may be disposed within first portion 124 of fluid line 122. Also, third portion 128 may be connected directly to adjustable pressure regulating valve 132. With this arrangement, fluid may flow within fluid line 122 between intake valve 130, adjustable pressure regulating valve 132 and flow valve 170. In particular, with this configuration, fluid inlet 152 of adjustable pressure regulating valve 132 and fluid inlet 172 of flow valve 170 are maintained at approximately the same pressure. Furthermore, when flow valve 170 is open, fluid inlet 152 of adjustable pressure regulating valve 132 and fluid inlet 116 of fluid chamber 110 are maintained at approximately the same pressure. This arrangement allows adjustable pressure regulating valve 132 to regulate the pressure of fluid chamber 110 when flow valve 170 is open.

In some embodiments, adaptive fluid system 120 may include external pump 190. Generally, external pump 190 may be any type of pump. Examples of different pumps include, but are not limited to: displacement pumps, buoyancy pumps, impulse pumps, velocity pumps, gravity pumps as well as any other kind of pumps. Furthermore, external pump 190 could be a stand pump, a hand pump or a foot pump. Also, external pump 190 could be a manual pump or an automatic pump that is controlled by a motor, for example.

In one embodiment, external pump 190 is a manually operated displacement pump. In addition, external pump 190 may be a stand pump. In particular, external pump 190 includes pump portion 192, handle portion 194 and hose portion 196. Hose portion 196 may be a substantially flexible hose or tube that can be connected to article 100. Using this arrangement, fluid may be pumped at pump portion 192 by raising and lowering handle portion 194. This causes fluid to be discharged from nozzle 198 of hose portion 196.

Figure 2:
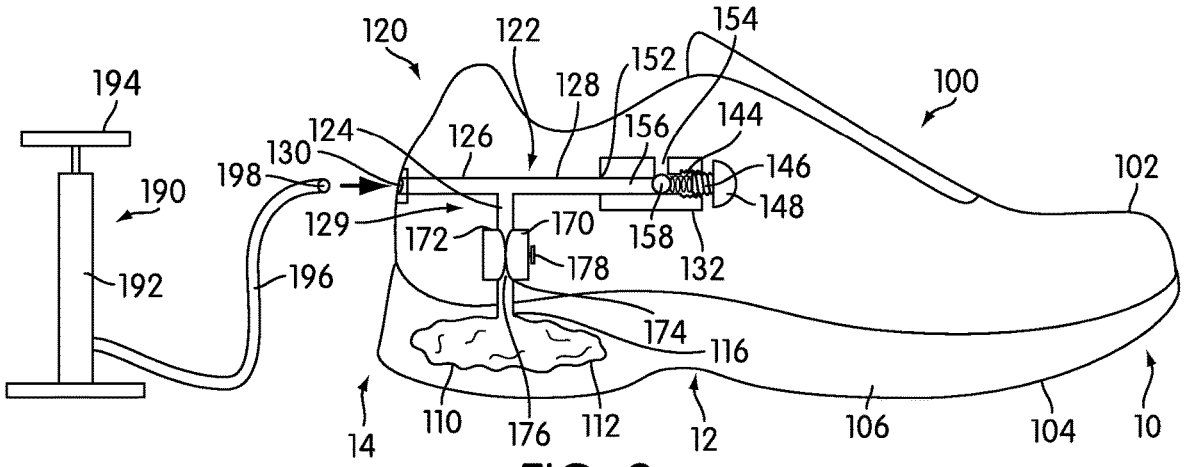
FIG. 2 is a schematic view of an embodiment of the adaptive fluid system for the article of footwear with an external pump connected to the article of footwear.

FIGS. 2 through 9 illustrate the operation of an embodiment of article 100. Referring to FIG. 2, external pump 190 may be connected to article 100. Specifically, nozzle 198 of hose portion 196 may be engaged with intake valve 130 of article 100. This may place fluid line 122 in fluid communication with external pump 190 to allow fluid chamber 110 to be inflated.

In the current embodiment, adjustable pressure regulating valve 132 may be set at a predetermined pressure. As previously discussed, a user may control the pressure of fluid chamber 110 by manually setting adjustable knob 148 to a desired setting. In some cases, adjustable pressure regulating valve 132 may be configured with a pressure level indicator that visually indicates to a user the currently selected maximum pressure setting. For example, in some cases, adjustable pressure regulating valve 132 may include a dial of some kind that displays the current setting for adjustable pressure regulating valve 132. As a user turns adjustable knob 148, the value indicated by the dial could change accordingly. In other cases any other kind of indicator could be used including, but not limited to: digital indicators, audible indicators as well as any other kind of indicators. Moreover, in some cases an indicator could display numerical pressure values. In other cases, however, an indicator could display words or indicia that indicate relative pressure values. As an example, a user could select between "low", "medium" and "high" pressure values by turning adjustable knob 148. As another example, a user could select any pressure setting in a range between "soft" and "firm," to indicate a range of pressure between low pressure and high pressure. Although the adjustable pressure regulating valve 132 of the current embodiment may be adjusted though a continuous range of pressure settings, in other embodiments an adjustable pressure regulating valve could be configured to operate in a discrete range of pressure settings.

Figure 3:
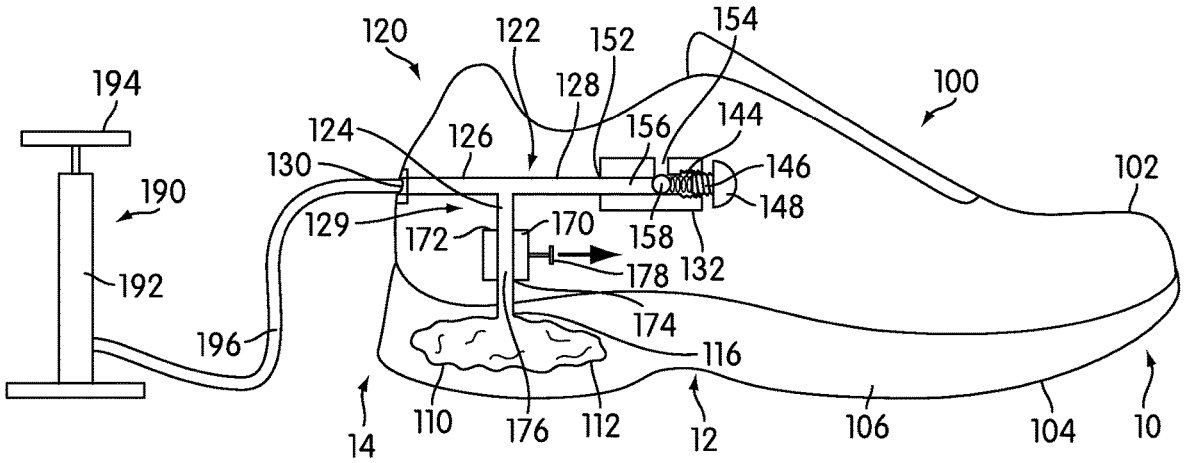
FIG. 3 is a schematic view of an embodiment of the adaptive fluid system for the article of footwear with a flow valve open.

Referring now to FIG. 3, once external pump 190 has been connected to intake valve 130, flow valve 170 may be opened. In particular, switch 178 may be operated so that fluid passage 176 is open and allows for fluid communication between fluid inlet 172 and fluid outlet 174 of flow valve 170. Moreover, with flow valve 170 open, fluid chamber 110 may be in fluid communication with intake valve 130, which is configured to receive fluid from external pump 190.

Figure 4:
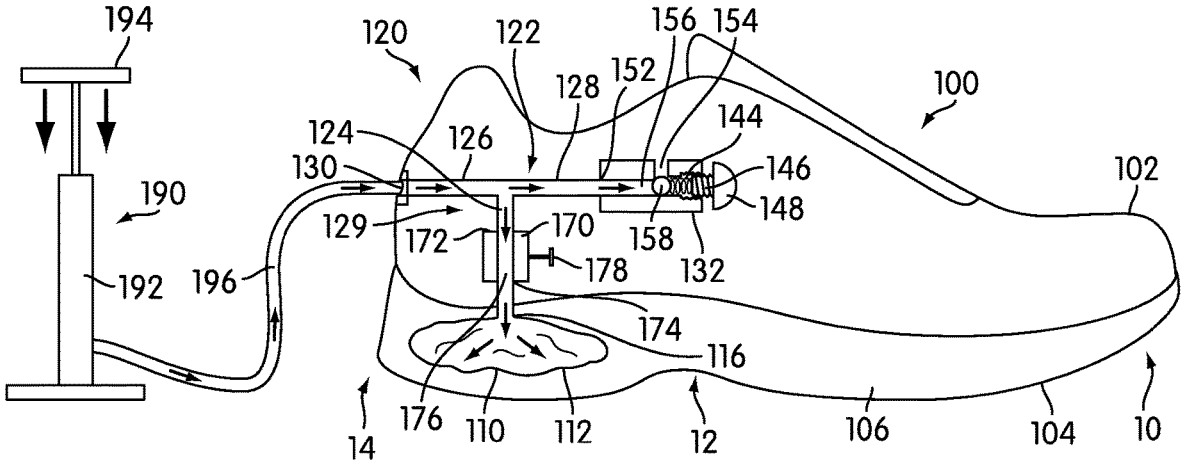
FIG. 4 is a schematic view of an embodiment of the adaptive fluid system for the article of footwear with the external pump being operated.

Referring now to FIG. 4, external pump 190 may be operated by raising and lowering handle portion 194. As handle portion 194 is raised and lowered, fluid within pump portion 192 may be displaced and communicated through hose portion 196. This fluid may enter fluid line 122 through intake valve 130. In this case, fluid flows through flow valve 170 and into fluid chamber 110. Furthermore, the pressure of fluid in fluid line 122 is less than the current maximum pressure setting associated with adjustable pressure regulating valve 132. Therefore, the pressure within fluid line 122 and fluid chamber 110 may be increased through additional pumping of external pump 190.

Figure 5:
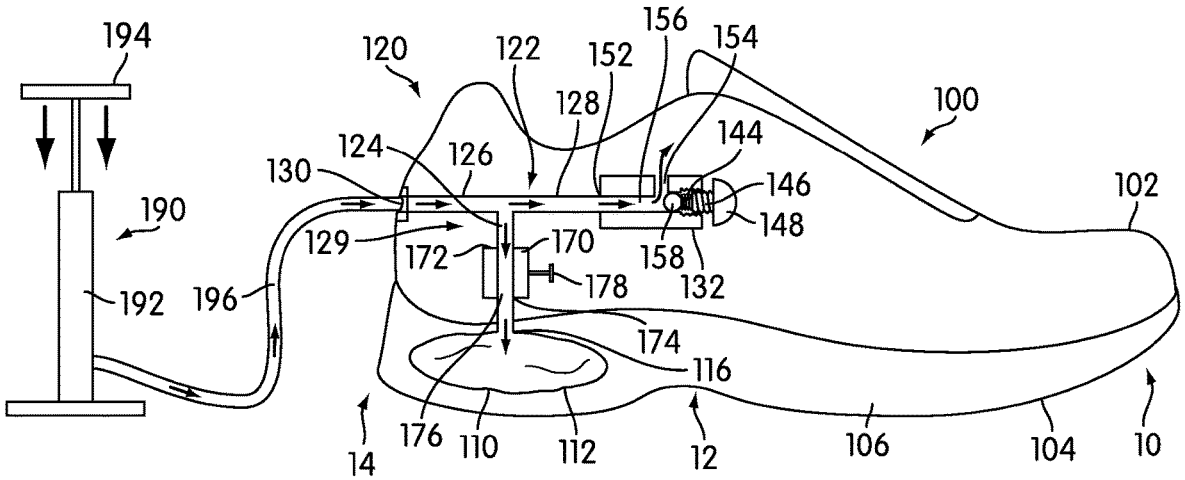
FIG. 5 is a schematic view of an embodiment of the adaptive fluid system for the article of footwear with an adjustable pressure regulating valve operating to limit the maximum pressure of the system.

Referring to FIG. 5, as the pressure in fluid line 122 exceeds the maximum pressure setting, the force exerted on ball 158 is large enough to compress spring 144. As spring 144 compresses and ball 158 is displaced towards screw 146, fluid may escape from adjustable pressure regulating valve 132 through fluid outlet 154. Furthermore, fluid may continue to exit through fluid outlet 154 until the pressure within fluid line 122 has dropped below the maximum pressure setting. At this point, spring 144 may expand and ball 158 may be returned to a position that blocks airflow to fluid outlet 154. Moreover, the pressure within fluid chamber 110 will be maintained at a pressure approximately equal to the maximum pressure setting, regardless of whether external pump 190 continues to pump fluid into article 100.

In the current embodiment, a user may determine that the pressure within fluid chamber 110 is not high enough. This can be done by trying on article 100 and applying a downward force to get a feel for the degree of cushioning or firmness of sole structure 104. In order to increase the pressure within fluid chamber 110 a user may manually adjust adjustable pressure regulating valve 132.

Figure 6:
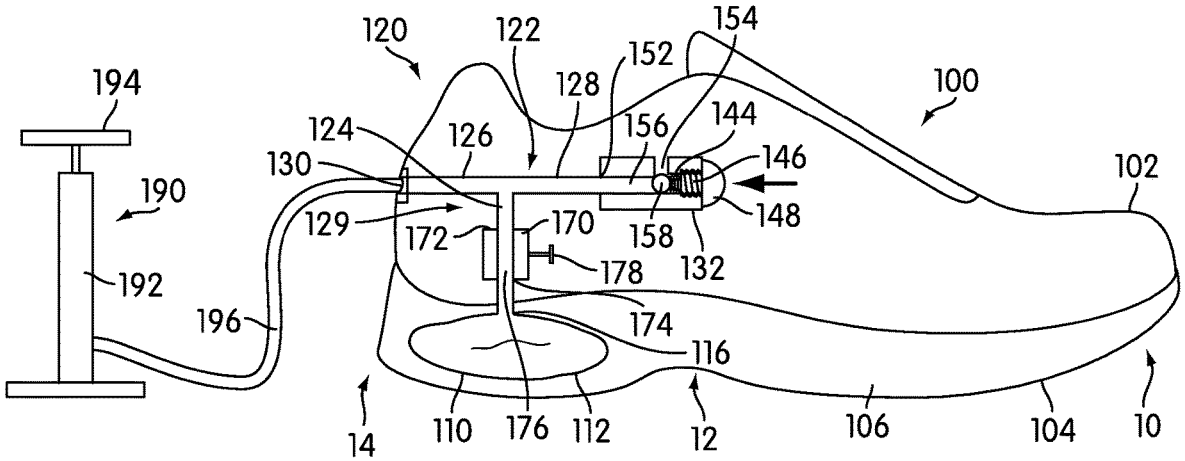
FIG. 6 is a schematic view of an embodiment of the adaptive fluid system for the article of footwear with a new maximum pressure setting for the adjustable pressure regulating valve.
Figure 7:
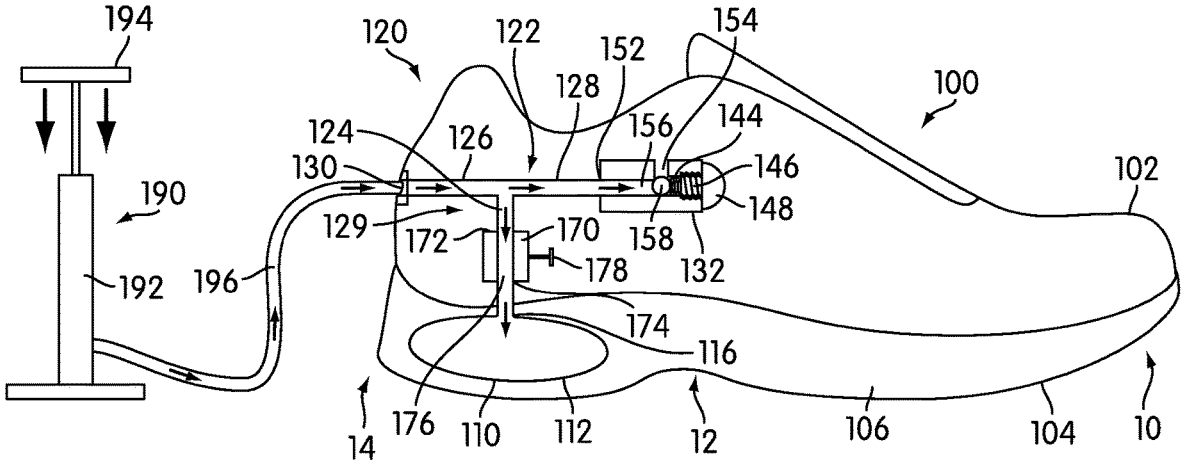
FIG. 7 is a schematic view of an embodiment of the adaptive fluid system for the article of footwear with a fluid chamber inflated.

Referring to FIG. 6, adjustable knob 148 may be rotated so that that spring 144 is compressed further by screw 146. This increases the spring force of spring 144 and thus the amount of pressure required to displace ball 158. In other words, the maximum pressure setting of adjustable pressure regulating valve 132 has been increased. Following this, as seen in FIG. 7, a user may continue to operate external pump 190 to pump more fluid into fluid line 122 and fluid chamber 110. The pressure inside fluid chamber 110 may increase until the pressure within fluid line 122 exceeds the new maximum pressure setting.

Figure 8:
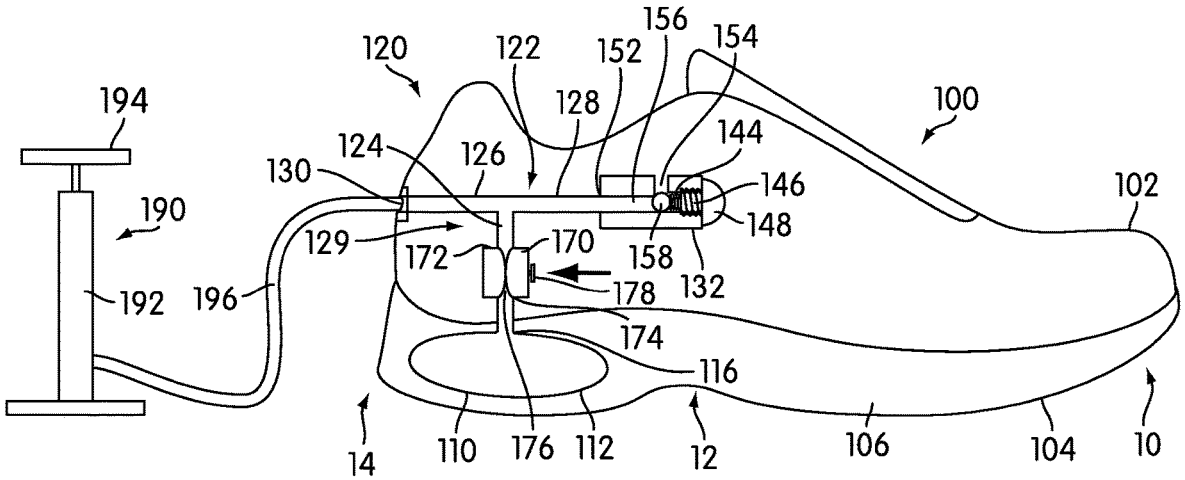
FIG. 8 is a schematic view of an embodiment of the adaptive fluid system for the article of footwear with the flow valve closed.
Figure 9:
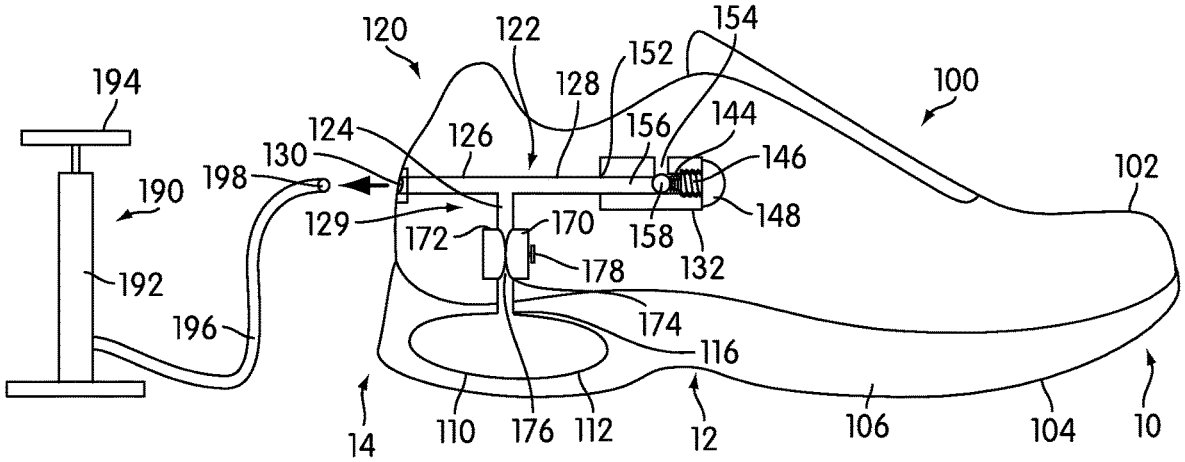
FIG. 9 is a schematic view of an embodiment of the adaptive fluid system for the article of footwear with the external pump disconnected.

Once fluid chamber 110 has been inflated to the desired pressure that is approximately equal to the maximum pressure setting, a user may close flow valve 170, as seen in FIG. 8. In particular, a user may operate switch 178 so that fluid passage 176 is closed. This may seal fluid chamber 110 so that the pressure within fluid chamber 110 can no longer be changed. Following this, as seen in FIG. 9, a user may disengage nozzle 198 of hose portion 196 to enable article 100 for use.

Figure 10:
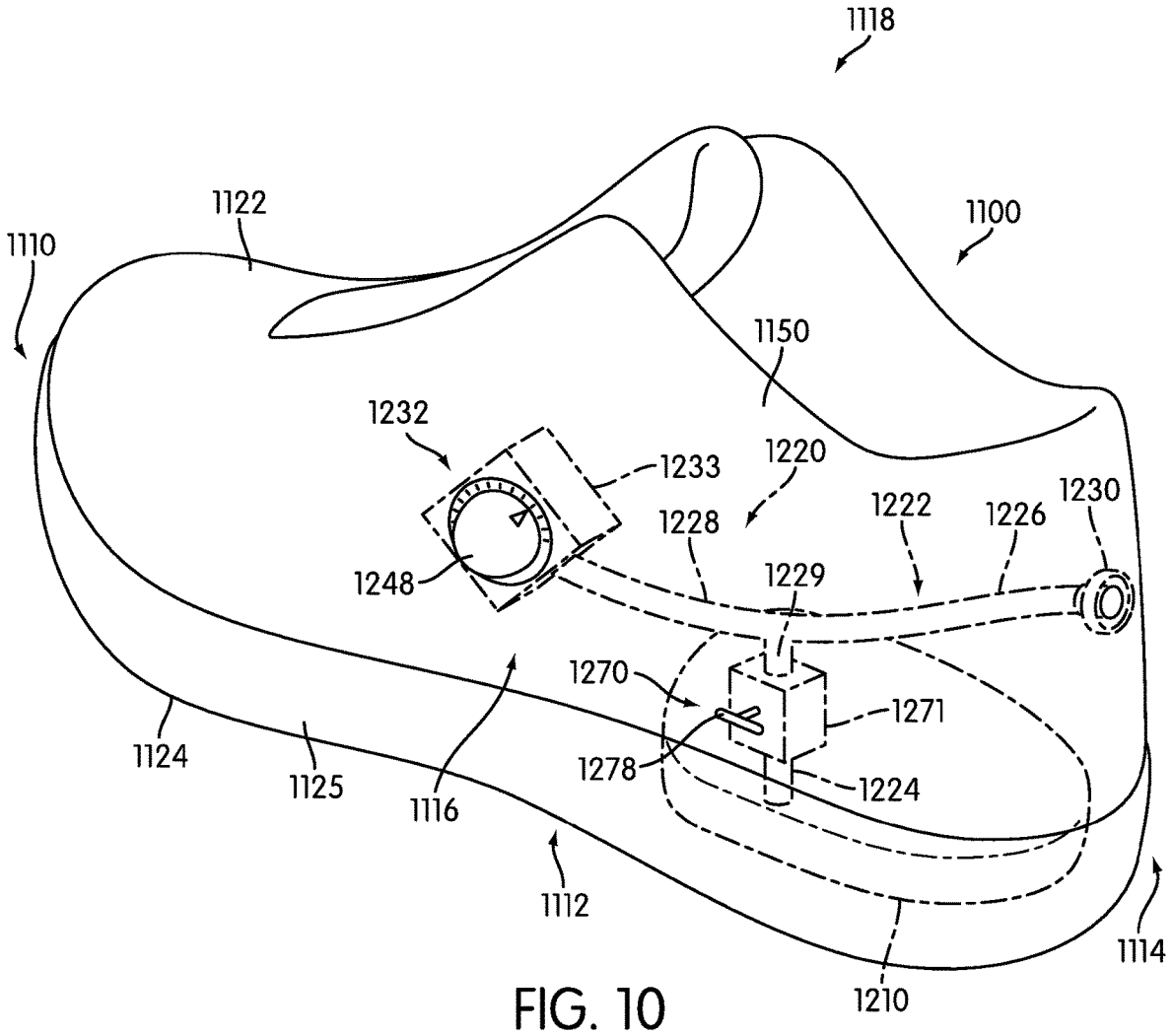
FIG. 10 is an isometric view of an embodiment of an adaptive fluid system for an article of footwear.
Figure 11:
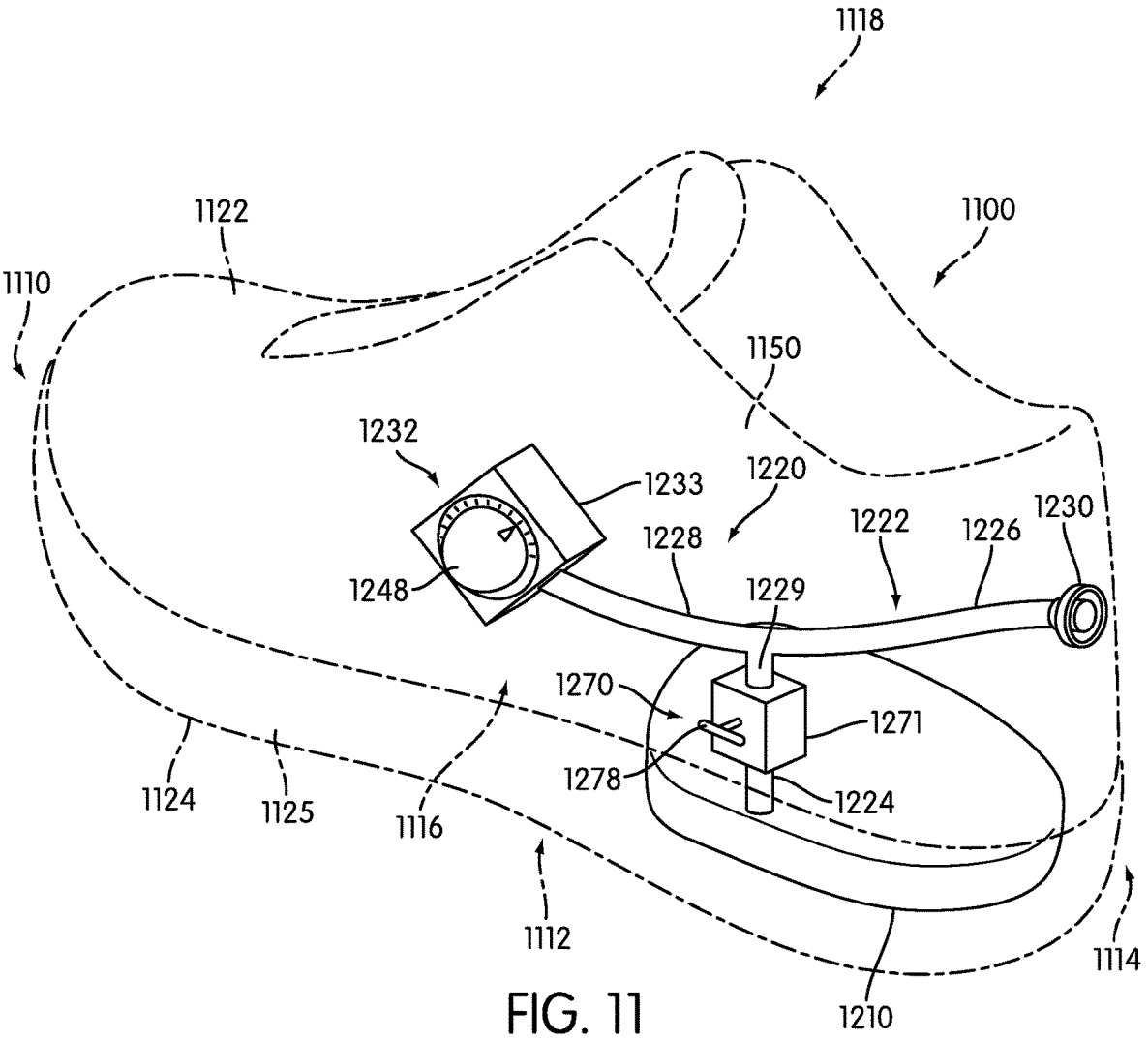
FIG. 11 is an isometric view of an embodiment of the adaptive fluid system for the article of footwear.

FIGS. 10 and 11 are intended to illustrate one possible configuration for an embodiment of adaptive fluid system 1220 that is disposed within article of footwear 1100, also simply referred to as article 1100. Referring to FIGS. 10 and 11, for purposes of reference, article 1100 may be divided into forefoot portion 1110, midfoot portion 1112 and heel portion 1114. Forefoot portion 1110 may be generally associated with the toes and joints connecting the metatarsals with the phalanges. Midfoot portion 1112 may be generally associated with the arch of a foot. Likewise, heel portion 1114 may be generally associated with the heel of a foot, including the calcaneus bone. In addition, article 1100 may include lateral side 1116 and medial side 1118. In particular, lateral side 1116 and medial side 1118 may be opposing sides of article 1100. Furthermore, both lateral side 1116 and medial side 1118 may extend through forefoot portion 1110, midfoot portion 1112 and heel portion 1114.

It will be understood that forefoot portion 1110, midfoot portion 1112 and heel portion 1114 are only intended for purposes of description and are not intended to demarcate precise regions of article 1100. Likewise, lateral side 1116 and medial side 1118 are intended to represent generally two sides of an article, rather than precisely demarcating article 1100 into two halves. In addition, forefoot portion 1110, midfoot portion 1112 and heel portion 1114, as well as lateral side 1116 and medial side 1118, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot portion to a heel portion of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 1100 can include upper 1122. Generally, upper 1122 may be any type of upper. In particular, upper 1122 may have any design, shape, size and/or color. For example, in embodiments where article 1100 is a basketball shoe, upper 1122 could be a high top upper that is shaped to provide high support on an ankle. In embodiments where article 1100 is a running shoe, upper 1122 could be a low top upper.

Article 1100 can include sole structure 1124. In some embodiments, sole structure 1124 may be configured to provide traction for article 1100. In addition to providing traction, sole structure 1124 may attenuate ground reaction forces when compressed between the foot and the ground during walking, running or other ambulatory activities. The configuration of sole structure 1124 may vary significantly in different embodiments to include a variety of conventional or non-conventional structures. In some cases, the configuration of sole structure 1124 can be configured according to one or more types of ground surfaces on which sole structure 1124 may be used. Examples of ground surfaces include, but are not limited to: natural turf, synthetic turf, dirt, as well as other surfaces.

Sole structure 1124 extends between the foot and the ground when article 1100 is worn. In different embodiments, sole structure 1124 may include different components. For example, sole structure 1124 may include an outsole, a midsole, and/or an insole. In some cases, one or more of these components may be optional.

Adaptive fluid system 1220 is provided with similar components to those discussed above and shown in FIGS. 1 through 9. In particular, adaptive fluid system 1220 may include fluid chamber 1210. In the current embodiment, fluid chamber 1210 is disposed within midsole 1125 of sole structure 1124. In particular, fluid chamber 1210 may be embedded within one or more materials comprising midsole 1125. For example, in one embodiment, midsole 1125 may comprise a foam material and fluid chamber 1210 may be embedded within the foam material.

Adaptive fluid system 1220 also comprises intake valve 1230, adjustable pressure regulating valve 1232 and flow valve 1270. In addition, intake valve 1230, adjustable pressure regulating valve 1232, flow valve 1270 and fluid chamber 1210 are all connected by fluid line 1222. In the current embodiment, intake valve 1230 is disposed in heel portion 1114 of upper 1122. However, in other embodiments, intake valve 1230 could be located in any other portion of upper 1122 and/or sole structure 1124.

Adjustable pressure regulating valve 1232 may be disposed on lateral side 1116 of upper 1122. In particular, adjustable pressure regulating valve 1232 is attached to sidewall 1150 of upper 1122. Adjustable pressure regulating valve 1232 may include body portion 1233 and adjustable knob 1248. In some cases, a portion of adjustable pressure regulating valve 1232 may be disposed on an outer portion of article 1100. In some cases, body portion 1233 of adjustable pressure regulating valve 1232 may be disposed internally to upper 1122, while adjustable knob 1248 may extend from an outer portion of sidewall 1150. This arrangement may provide a user access to adjustable knob 1248 for purposes of adjusting the maximum pressure setting of adaptive fluid system 1220.

Flow valve 1270 may also be disposed on sidewall 1150 of upper 1122. In some cases, flow valve 1270 may be disposed rearwardly of adjustable pressure regulating valve 1232. However, in other embodiments, the relative locations of adjustable pressure regulating valve 1232 and flow valve 1270 can be varied. In some cases, portions of flow valve 1270 may be disposed on an inner portion of article 1100 while other portions may be disposed on an outer portion of article 1100. In one embodiment, flow valve 1270 may comprise base portion 1271 that is disposed internally to upper 1122 and switch 1278 that is disposed on an outer portion of sidewall 1150. This arrangement allows a user to easily operate switch 1278 for purposes of opening and closing flow valve 1270.

In some embodiments, portions of fluid line 1222 may be attached to the interior sidewalls of upper 1122. In the current embodiment, first portion 1224 extends from fluid chamber 1210, through a portion of midsole 1125 and along an interior portion of sidewall 1150 of upper 1122. In a similar manner, second portion 1226 extends along an interior portion of upper 1122 from heel portion 14 to sidewall 1150. Third portion 1228 also extends along an interior portion of sidewall 1150 between adjustable pressure regulating valve 1232 and intersection 1229, which is the intersection of first portion 1224, second portion 1226 and third portion 1228. This arrangement may help prevent any damage to fluid line 1222 as a foot is inserted into upper 1122.

Figure 12:
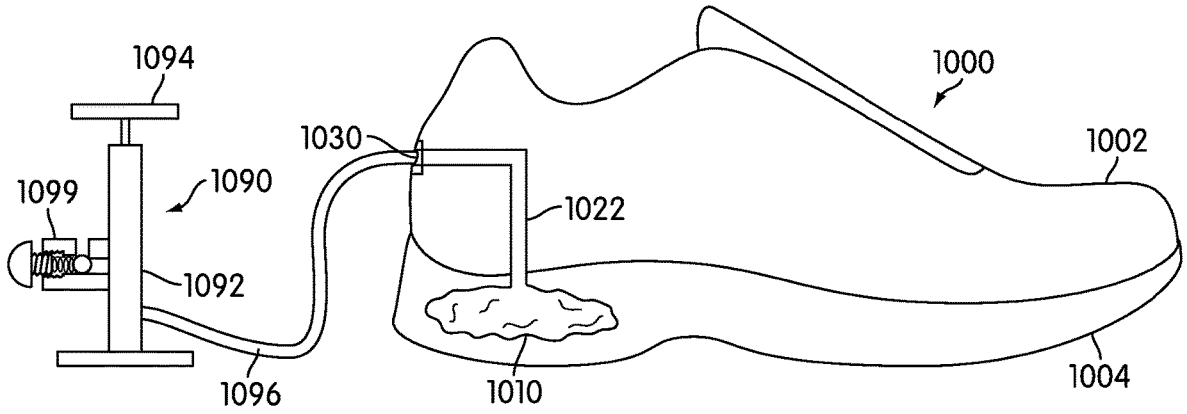
FIG. 12 is a schematic view of another embodiment of an adaptive fluid system for an article of footwear.

FIG. 12 illustrates another embodiment of a configuration for an adaptive fluid system. Referring to FIG. 12, article 1000 may be substantially similar to article 100 discussed in an earlier embodiment in illustrated in FIG. 1. In particular, article 1000 may include upper 1002 and sole structure 1004. In addition, article 1000 may include fluid chamber 1010. Furthermore, article 1000 includes intake valve 1030 and fluid line 1022 that provides fluid communication between intake valve 1030 and fluid chamber 1010. However, in contrast to the previous embodiments, article 1000 does not include a flow valve or an internal adjustable pressure regulating valve.

In the current embodiment, article 1000 may be configured to engage external pump 1090. External pump 1090 may be provided with pump portion 1092, handle portion 1094 and hose portion 1096. In addition, external pump 1090 may include adjustable pressure regulating valve 1099. Adjustable pressure regulating valve 1099 may function in a substantially similar manner to adjustable pressure regulating valve 132 of the earlier embodiment. In particular, a user may select a maximum pressure setting using adjustable pressure regulative valve 1099. As external pump 1090 is operated to fill fluid chamber 1010, pressure levels above the maximum pressure setting will result in fluid escaping from adjustable pressure regulating valve 1099, which is upstream of intake valve 1030.

Figure 13:
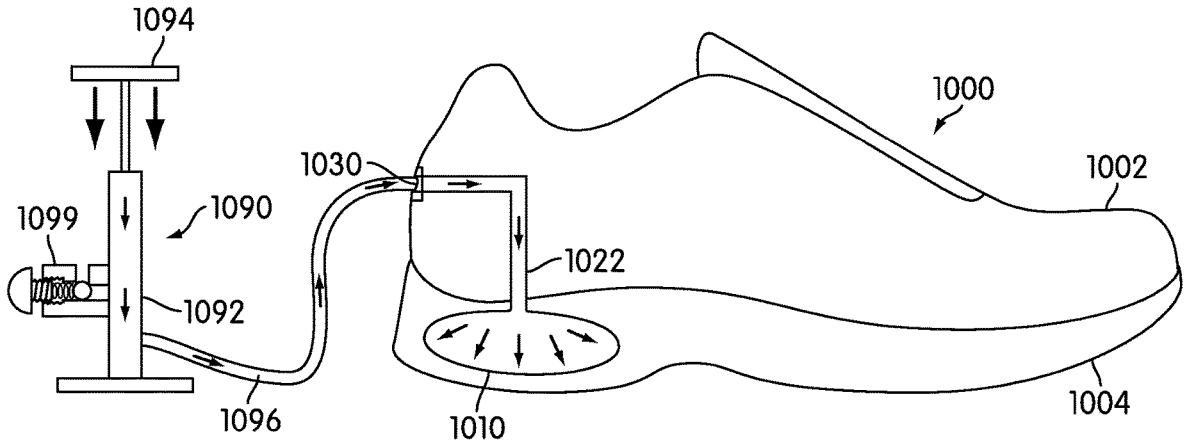
FIG. 13 is a schematic view of the embodiment of the adaptive fluid system with the external pump being operated.
Figure 14:
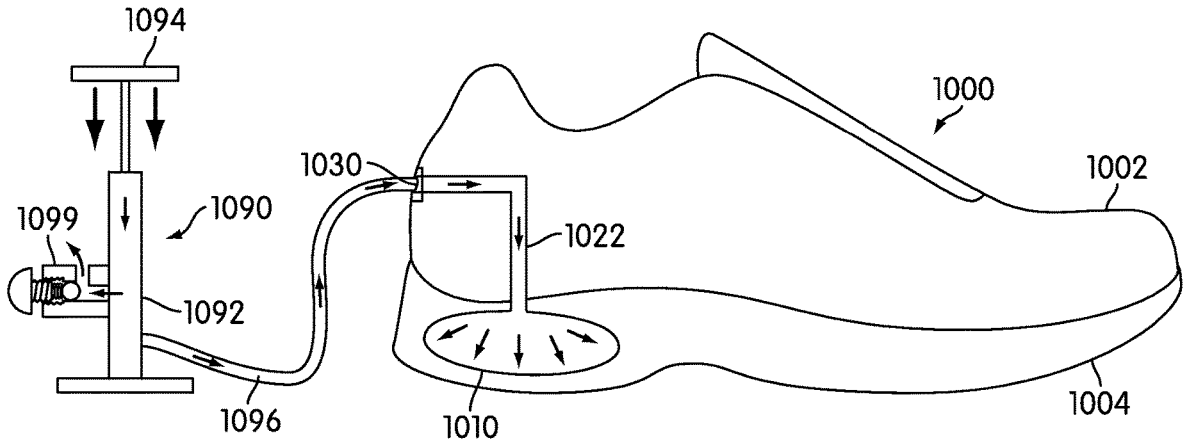
FIG. 14 is a schematic view of the embodiment of the adaptive fluid system with the external pump being operated.

FIGS. 13 and 14 illustrate embodiments of steps of inflating fluid chamber 1010. Referring to FIGS. 13 and 14, adjustable pressure regulating valve 1099 may be set to a predetermined maximum pressure setting. As fluid is pumped into fluid chamber 1010, fluid chamber 1010 may inflate. As the pressure within fluid line 1022 rises above the maximum pressure setting, fluid may escape from adjustable pressure regulating valve 1099 so that the pressure downstream of adjustable pressure regulating valve 1099 is maintained below the maximum pressure setting. This configuration helps to prevent fluid chamber 1010 from being over inflated.

Figure 15:
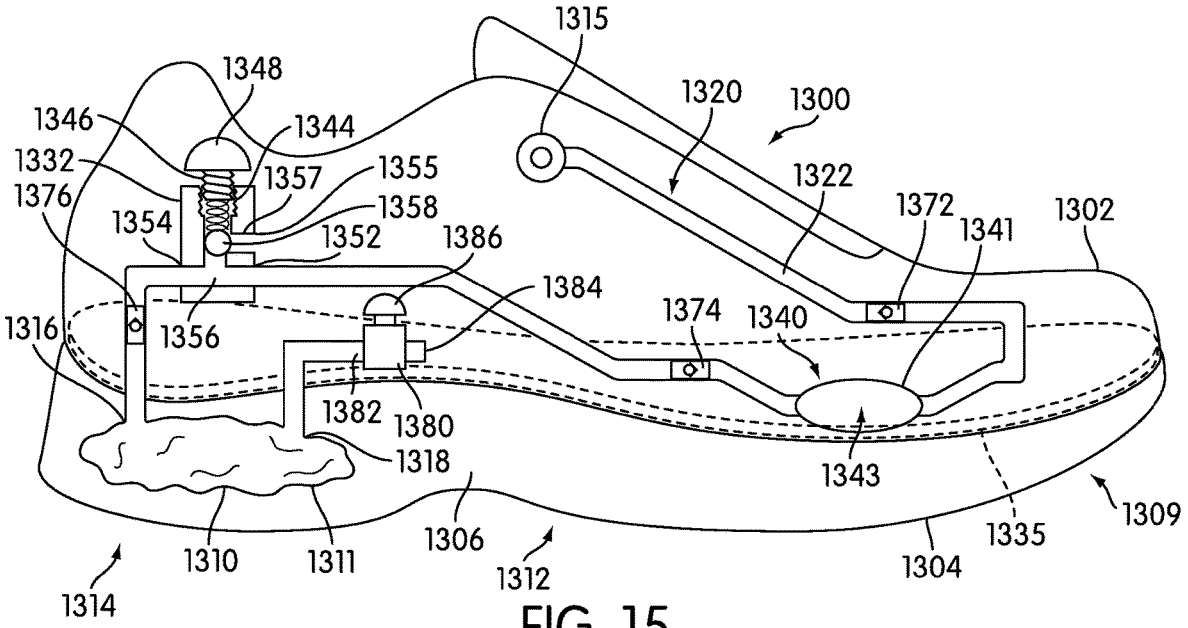
FIG. 15 is a schematic view of an embodiment of an adaptive fluid system for an article of footwear including an internal pump.

FIG. 15 illustrates another embodiment of a configuration for an adaptive fluid system. Referring to FIG. 15, article of footwear 1300, also referred to simply as article 1300, may be configured with upper 1302 and sole structure 1304, also referred to as sole 1304. In addition, the current embodiment illustrates some components of article 1300 but may not illustrate all components of article 1300.

In the current embodiment, article of footwear 1300 may include fluid chamber 1310. Fluid chamber 1310 can be any kind of fluid chamber that is configured to receive a fluid of some kind. In some embodiments, fluid chamber 1310 could be substantially similar to fluid chamber 110 shown in FIG. 1 and discussed above. In other embodiments, however, fluid chamber 1310 could have any other properties.

Fluid chamber 1310 may be disposed in any portion of article 1300. In the current embodiment, fluid chamber 1310 is disposed in sole structure 1304 of article 1300. In particular, in some cases, fluid chamber 1310 may be disposed in midsole 1306 of sole structure 1304. In other cases, however, fluid chamber 1310 could be disposed in an outsole or insole of sole structure 1304. Furthermore, fluid chamber 1310 may be enclosed within midsole 1306. In other cases, fluid chamber 1310 could be partially enclosed within midsole 1306, with some portions extending above or below midsole 1306. In still other cases, some portions of fluid chamber 1310 could be flush with an upper surface and/or a lower surface of midsole 1306.

In the current embodiment, fluid chamber 1310 may be disposed in heel portion 1314 of article 1300. However, in other embodiments, fluid chamber 1310 could be disposed in forefoot portion 1309 or midfoot portion 1312. In still other embodiments, fluid chamber 1310 could be configured to extend through multiple portions of article 1300 including any of forefoot portion 1309, midfoot portion 1312 and/or heel portion 1314.

In other embodiments, fluid chamber 1310 could be disposed in any other portion of article 1300. In some cases, for example, fluid chamber 1310 could be disposed in any portion of upper 1302. Furthermore, in still other cases, fluid chamber 1310 could be disposed in any other footwear component that may be used with article 1300, including, but not limited to: insoles, lasting boards, liners as well as any other components associated with an article of footwear.

Fluid chamber 1310 may include outer lining 1311 that encloses fluid filled chamber 1310. Outer lining 1311 may be substantially impermeable to fluid so that fluid cannot escape from fluid chamber 1310. Fluid chamber 1310 may further include fluid inlet 1316 that is disposed on outer lining 1311 and that provides fluid communication to fluid chamber 1310. In addition, fluid chamber 1310 can include fluid outlet 1318 disposed on another portion of outer lining 1311. It will be understood that in some cases, fluid can flow into and out of both fluid inlet 1316 and fluid outlet 1318.

Generally, fluid chamber 1310 can have any size and geometry. Examples of some possible geometries include, but are not limited to: box-like shapes, hemispherical shapes, regular three dimensional geometries, irregular three dimensional geometries as well as any other kinds of geometries. Furthermore, in other embodiments, article 1300 can be configured with multiple fluid chambers, rather than a single fluid chamber. In other embodiments, two or more fluid chambers could be used.

Article 1300 can include adaptive fluid system 1320. Adaptive fluid system 1320 may include fluid chamber 1310 as well as additional components for adjusting the pressure of a fluid within fluid chamber 1310. In this embodiment, adaptive fluid system 1320 may include fluid line 1322 for communicating fluid through article 1300. Fluid line 1322 may be any type of line configured to transmit fluid from one location to another. In some cases, fluid line 1322 could be a flexible tube or hose of some kind. In other cases, fluid line 1322 could comprise piping of some kind.

Article 1300 can include filter assembly 1315. Filter assembly 1315 may provide fluid communication between adaptive fluid system 1320 and the ambient environment of article 1300. Generally, any type of filter assembly may be used. In one embodiment, filter assembly 1315 may have the general structure of a filter assembly described in Stashick, U.S. Patent Publication Number US2002/0194747, published Dec. 26, 2002 (U.S. application Ser. No. 09/887,523, filed Jun. 21, 2001), the entirety of which is herein incorporated by reference. Filter assembly 1315 may include one or more perforations that permit at least one type of fluid to pass into fluid line 1322, while preventing debris and/or unwanted fluids from passing into adaptive fluid system 1320. For example, in one embodiment, filter assembly 1315 may allow air to pass into fluid line 1322 while preventing water and debris from entering fluid line 1322 to protect the various components of adaptive fluid system 1320.

An article can include provisions for inflating a fluid chamber through normal use of an article of footwear. In some cases, an article can include an internal pump that is operated during normal use of an article of footwear. In an exemplary embodiment, an article can include an internal pump that is activated as a user applies downward pressure on a sole of the article.

Adaptive fluid system 1320 may include internal pump 1340. Internal pump 1340 may be any type of internal pump. An example of one type of internal pump is disclosed in U.S. Pat. No. 7,451,554, the entirety of which is hereby incorporated by reference. However, in other embodiments, any other type of internal pump could be included.

In different embodiments, the size of internal pump 1340 may vary. In some cases, internal pump 1340 could be substantially smaller than fluid chamber 1310. In other cases, internal pump 1340 could be substantially larger than fluid chamber 1310. Moreover, in different embodiments, the geometry of internal pump 1340 could vary.

In one embodiment, internal pump 1340 could comprise outer lining 1341 that encloses pumping chamber 1343. In some cases, outer lining 1341 could comprise a substantially similar material to outer lining 1311 of fluid chamber 1310. In other cases, outer lining 1341 of internal pump 1340 and outer lining 1311 of fluid chamber 1310 could comprise substantially different materials. Examples of different materials include any of those discussed for the previous embodiments as well as any other materials.

In different embodiments, the location of internal pump 1340 could vary. In some embodiments, internal pump 1340 could be disposed in upper 1302. In other embodiments, internal pump 1340 could be disposed in sole structure 1304. In an exemplary embodiment, article 1300 may include insole member 1335 that includes internal pump 1340. In still other embodiments, internal pump 1340 could be associated with any other portion of article 1300 as well as any footwear component that may be associated with article 1300.

Adaptive fluid system 1320 may include one or more valves that facilitate the communication of fluid through article 1300. In some embodiments, adaptive fluid system 1320 may include adjustable pressure regulating valve 1332 that helps to limit the maximum pressure within fluid line 1322. Adjustable pressure regulating valves are known in the art. In one embodiment, adjustable pressure regulating valve 1332 may comprise a ball and spring type regulating valve. In this case, adjustable pressure regulating valve 1332 includes fluid inlet 1352 and first fluid outlet 1354, which are connected by way of first passage 1356. Adjustable pressure regulating valve 1332 also includes second fluid outlet 1355 that is in fluid communication with first passage 1356 by way of second passage 1357. In addition, adjustable pressure regulating valve 1332 includes ball 1358 that is disposed against spring 1344. Also, spring 1344 is disposed against screw 1346 of adjustment knob 1348. If the pressure within fluid line 1322 is raised above a predetermined threshold, spring 1344 is compressed so that ball 1358 is no longer disposed between fluid inlet 1352 and second fluid outlet 1355. In this situation, fluid can escape from second fluid outlet 1355, which reduces with pressure within fluid line 1322 until the pressure is below the threshold pressure. At this point, ball 1358 may return to a position that blocks fluid communication with second fluid outlet 1355. Furthermore, by turning adjustment knob 1348, the tension of spring 1344 may be adjusted, which increases or decreases the amount of pressure required to move ball 1358. It will be understood that the current embodiment of adjustable pressure regulating valve 1332 is only intended to be exemplary. In other embodiments, any other type of pressure regulating valve may be used.

Adaptive fluid system 1320 can include provisions for controlling the direction of fluid flow within fluid line 1322. In some cases, adaptive fluid system 1320 may include one or more one-way valves that prevent fluid from escaping from fluid chamber 1310 and fluid line 1322. In the exemplary embodiment, adaptive fluid system 1320 includes first one way valve 1372, second one way valve 1374 and third one way valve 1376. First one way valve 1372 is disposed downstream of filter assembly 1315 and upstream of internal pump 1340. This arrangement helps to prevent fluid from leaving internal pump 1340 through filter assembly 1315. Second one way valve 1374 is disposed downstream of internal pump 1340 and upstream of adjustable pressure regulating valve 1332. This arrangement helps to prevent fluid that has been pumped from internal pump 1340 from returning back to internal pump 1340 when the pressure of fluid line 1322 is too high. Furthermore, third one way valve 1376 may be disposed downstream of adjustable pressure regulating valve 1332 and upstream of fluid chamber 1310. This arrangement for third one way valve 1376 helps to prevent fluid from escaping out of fluid chamber 1310, especially during the use of article 1300 when momentary impacts may temporarily increase the pressure within fluid line 1322 and fluid chamber 1310. In other words, third one way valve 1376 helps to prevent fluid from being squeezed out of fluid chamber 1310 during use.

Generally, first one way valve 1372, second one way valve 1374 and third one way valve 1376 could be any type of one way valves. In some cases, first one way valve 1372, second one way valve 1374 and third one way valve 1376 may comprise duckbill valves manufactured by Vernay Laboratories, Inc., and the two-layer polymer valves disclosed in U.S. Pat. No. 5,144,708 to Pekar and U.S. Pat. No. 5,564,143, to Pekar et al. Both types of valves are generally considered one-directional valves that permit fluid flow in a first direction, but limit fluid flow in an opposite second direction.

Adaptive fluid system 1320 can include provisions that allow a user to manually reduce the pressure within fluid chamber 1310. In some cases, adaptive fluid system 1320 can include manual release valve 1380. Manual release valve 1380 can include fluid inlet 1382 and fluid outlet 1384. Fluid inlet 1382 may be downstream of fluid chamber 1310. In an exemplary embodiment, manual release valve 1380 may be spaced apart from fluid chamber 1310 by a portion of fluid line 1322.

In some cases, manual release valve 1380 can include release button 1386. Although a button is used in the current embodiment, in other embodiments any type of switch, dial, knob or other means of operating a valve could be used. Normally, fluid inlet 1382 and fluid outlet 1384 may not be in fluid communication. However, when release button 1386 is pressed by a user, manual release valve 1380 may be placed in an open position. In the open position fluid inlet 1382 and fluid outlet 1384 may be in fluid communication, which allows fluid to escape from fluid chamber 1310 and thereby reduces the pressure of fluid chamber 1310. Moreover, after release button 1386 has been released, manual release valve 1380 may return to a closed position in which fluid communication is prevented between fluid inlet 1382 and fluid outlet 1384. In other words, manual release valve 1380 may only be opened as long as a user is pressing down on release button 1386.

Figure 16:
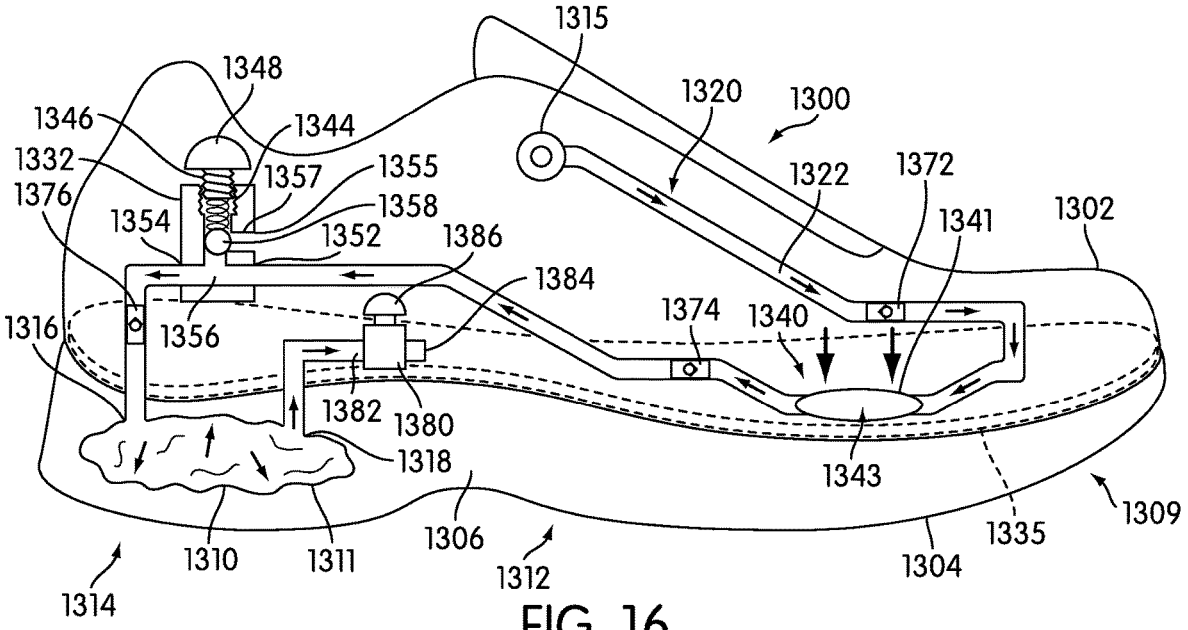
FIG. 16 is a schematic view of the embodiment of the adaptive fluid system for the article of footwear with the internal pump operated.

FIGS. 16 through 20 are intended to illustrate one possible operation of an embodiment of adaptive fluid system 1320. Initially, as seen in FIG. 16, internal pump 1340 may be activated as a user walks, runs, or otherwise applies pressure to internal pump 1340. As internal pump 1340 is depressed, fluid may be expelled downstream of internal pump 1340 and through second one way valve 1374. As internal pump 1340 is released, internal pump 1340 may draw in fluid through filter assembly 1315. In an exemplary embodiment, fluid, such as air, may enter through filter assembly 1315 and travel along fluid line 1322 through first one way valve 1372 and into internal pump 1340.

Fluid released downstream of internal pump 1340 may travel through second one way valve 1374 and then into adjustable pressure regulating valve 1332. At this point, the pressure of the fluid may be below the current maximum pressure setting corresponding to the current position of adjustable knob 1348. Therefore, the fluid may continue downstream of adjustable pressure regulating valve 1332 and through third one way valve 1376. After passing through third one way valve 1376, the fluid may enter fluid chamber 1310. Some of the fluid may exit through fluid outlet 1318 of fluid chamber 1310 and travel downstream to manual pressure release valve 1380. However, the fluid will be stopped at fluid inlet 1382 of manual release valve 1380 since manual release valve 1380 is not open.

Figure 17:
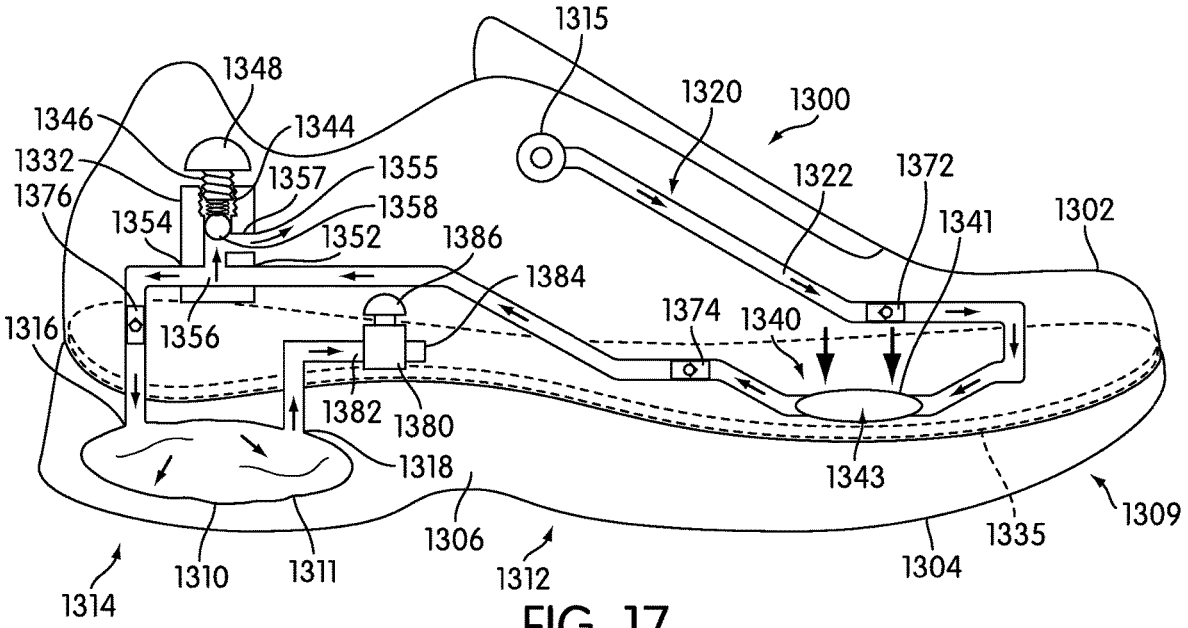
FIG. 17 is a schematic view of an embodiment of the adaptive fluid system for the article of footwear with an adjustable pressure regulating valve operating to maintain the pressure of the system below the maximum pressure setting.

Referring now to FIG. 17, as the pressure within fluid line 1322 rises above the maximum pressure setting, adjustable pressure regulating valve 1332 may open to allow fluid to escape from second fluid outlet 1355. In particular, spring 1344 may compress, and ball 1358 may be displaced to allow fluid communication between second fluid outlet 1355 and first passage 1356.

Figure 18:
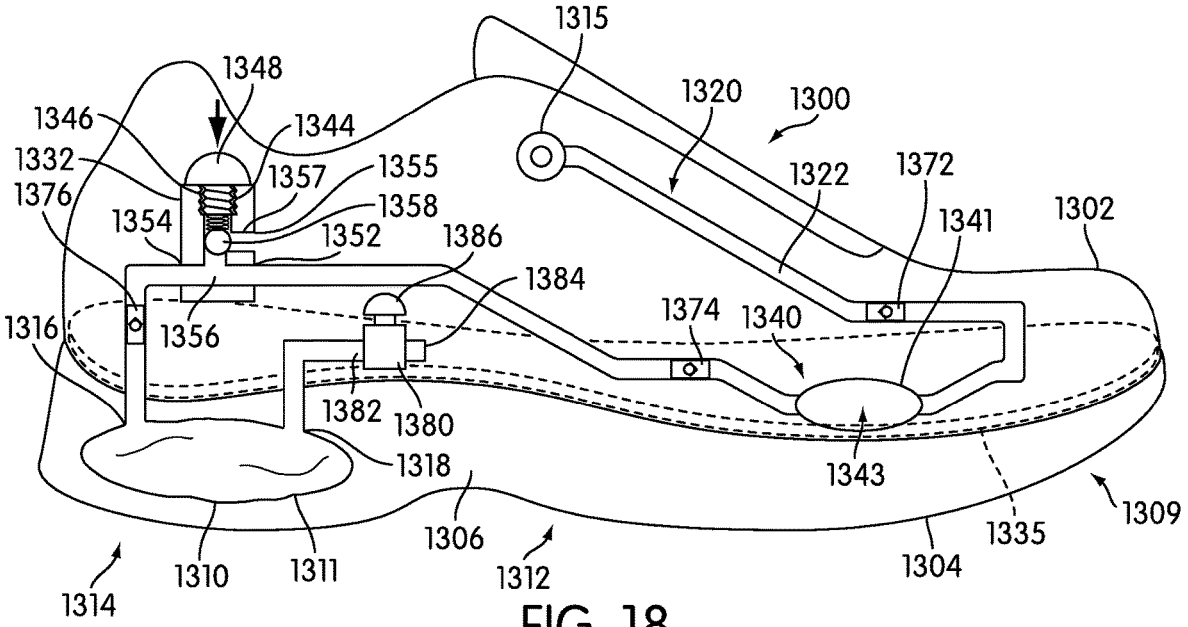
FIG. 18 is a schematic view of an embodiment of the adaptive fluid system for the article of footwear with a new setting for the adjustable pressure regulating valve.
Figure 19:
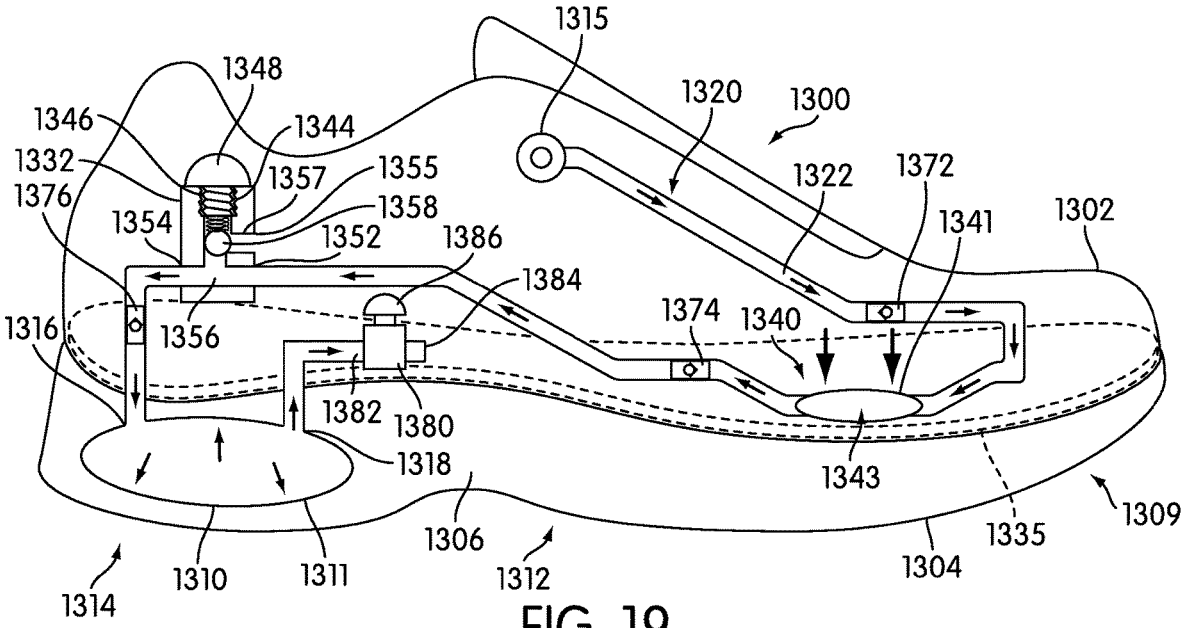
FIG. 19 is a schematic view of an embodiment of the adaptive fluid system for the article of footwear with a fluid chamber inflated.

Referring now to FIG. 18, the maximum pressure setting of adjustable pressure regulating valve 1332 may be increased by turning adjustment knob 1348. As internal pump 1340 is operated again, the pressure of fluid line 1322 may be increased up to the new maximum pressure setting. In particular, the pressure within fluid chamber 1310 can be increased to the maximum pressure setting. As seen in FIG. 19, the pressure within fluid line 1322, and fluid chamber 1310, may now be increased to a greater pressure. In this case, fluid chamber 1310 can be fully inflated.

Figure 20:
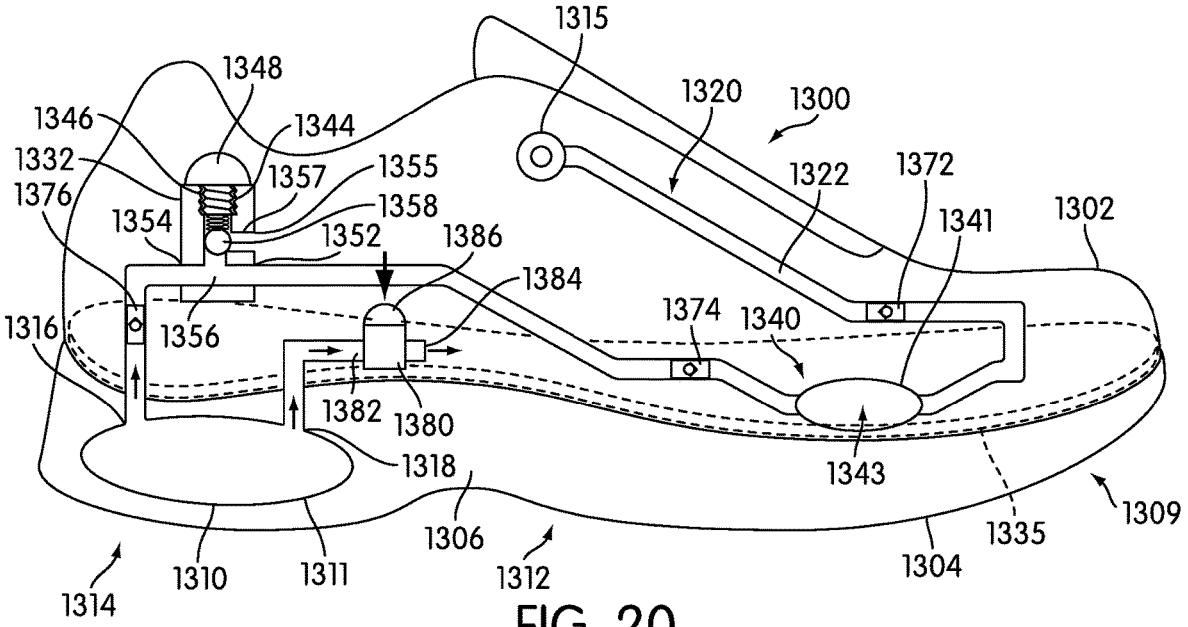
FIG. 20 is a schematic view of an embodiment of the adaptive fluid system for the article of footwear with fluid being released from the fluid chamber using a manual pressure release valve.

Referring now to FIG. 20, a user may decide that the pressure within fluid chamber 1310 is too high. In this case, a user may press release button 1386 of manual release valve 1380. This places fluid inlet 1382 and fluid outlet 1384 in fluid communication, which allows fluid from fluid chamber 1310 to escape. In other words, the pressure of fluid chamber 1310 may be reduced.

Figure 21:
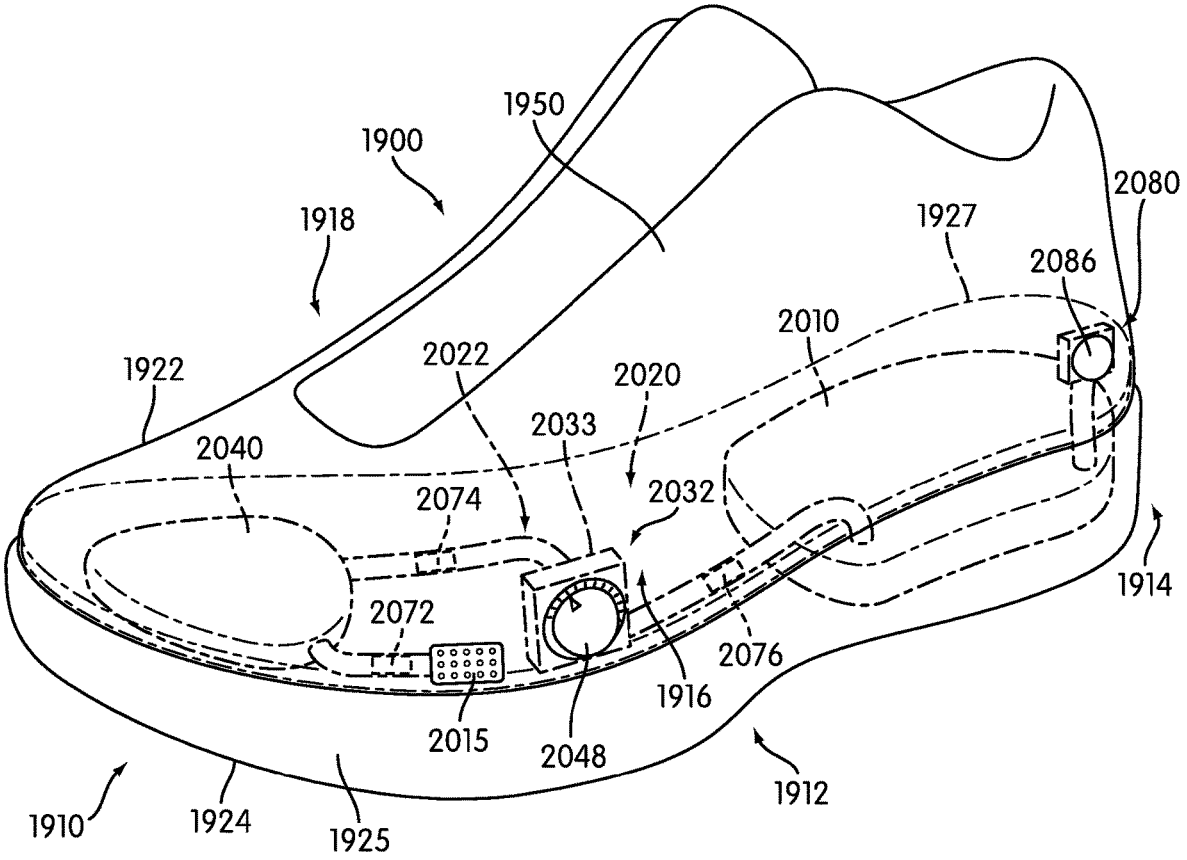
FIG. 21 is an isometric view of an embodiment of an article of footwear with an adaptive fluid system.
Figure 22:
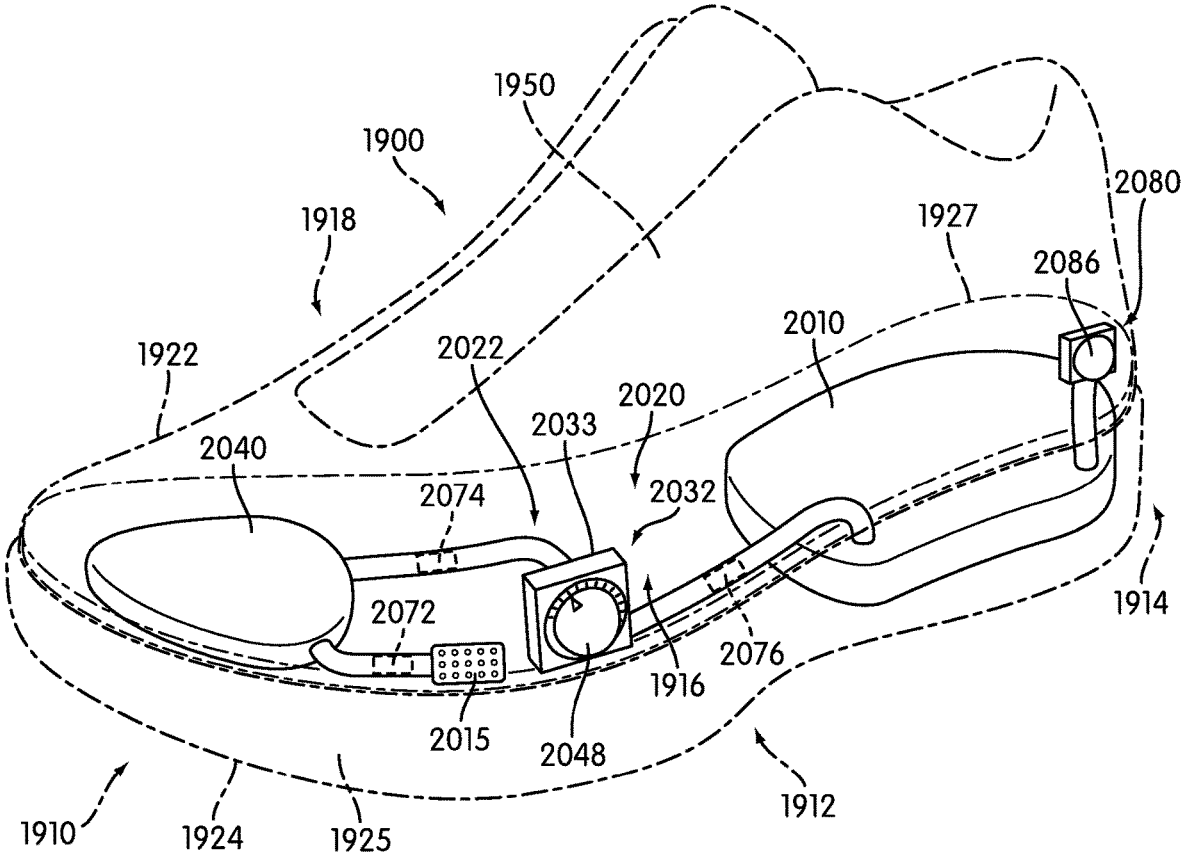
FIG. 22 is an isometric view of an embodiment of the article of footwear with the adaptive fluid system.

FIGS. 21 and 22 are intended to illustrate one possible configuration for an embodiment of adaptive fluid system 2020 that is disposed within article of footwear 1900, also referred to simply as article 1900. Article 1900 may be substantially similar to articles of the previous embodiments. In particular, article 1900 may include upper 1922 and sole structure 1924. Moreover, article 1900 includes forefoot portion 1910, midfoot portion 1912 and heel portion 1914, as well as lateral side 1916 and medial side 1918.

In the current embodiment, adaptive fluid system 2020 includes filter assembly 2015, internal pump 2040, adjustable pressure regulating valve 2032 and fluid chamber 2010. Each of these components is connected using fluid line 2022. Furthermore, as in the previous embodiment, internal pump 2040 is downstream of filter assembly 2015 and upstream of adjustable pressure regulating valve 2032. Likewise, adjustable pressure regulating valve 2032 is upstream of fluid chamber 2010. Adaptive fluid system 2020 also includes manual pressure release valve 2080 that is down stream of fluid chamber 2010.

In some embodiments, fluid chamber 2010 may be associated with sole structure 1924. In some cases, fluid chamber 2010 could be disposed in midsole 1925 of sole structure 1924. In other cases, fluid chamber 2010 could be disposed in insole 1927. In an exemplary embodiment, fluid chamber 2010 is enclosed within midsole 1925.

Additionally, adaptive fluid system 2020 is provided with first one way valve 2072, second one way valve 2074 and third one way valve 2076. First one way valve 2072 is disposed along fluid line 2022 between filter assembly 2015 and internal pump 2040. Second one way valve 2074 is disposed between internal pump 2040 and adjustable pressure regulating valve 2032. Third one way valve 2076 is disposed between adjustable pressure regulating valve 2032 and fluid chamber 2010. This arrangement provides for substantially similar operation of adaptive fluid system 2020 as adaptive fluid system 1320 described in the earlier embodiment.

In the current embodiment, filter assembly 2015 is disposed on sidewall 1950 of upper 1922. In particular, filter assembly 2015 may be exposed to ambient air. Likewise, adjustable pressure regulating valve 2032 may be disposed in sidewall 1950. In particular, base portion 2033 may be disposed internally to upper 2022, while adjustment knob 2048 may be exposed on sidewall 1950. This configuration may allow a user easy access to adjustment knob 2048. In some embodiments, manual pressure release valve 2080 may also be disposed on sidewall 1950. In some cases, base portion 2033 may be disposed internally to upper 1922, while release button 2086 may be exposed externally on sidewall 1950. This arrangement allows a user easy accessibility to release button 2086 for purposes of deflating fluid chamber 2010.

In some embodiments, internal pump 2040 may be disposed within insole 1927 of sole structure 1924. In other embodiments, however, internal pump 2040 could be disposed in any other portion of article 1900. Although the current embodiment uses an internal pump that is operated by applying pressure with a foot, in other embodiments, internal pump 2040 could be partially exposed on an outer portion of upper 1922 to allow a user to manually operate internal pump 2040.

Figure 23:
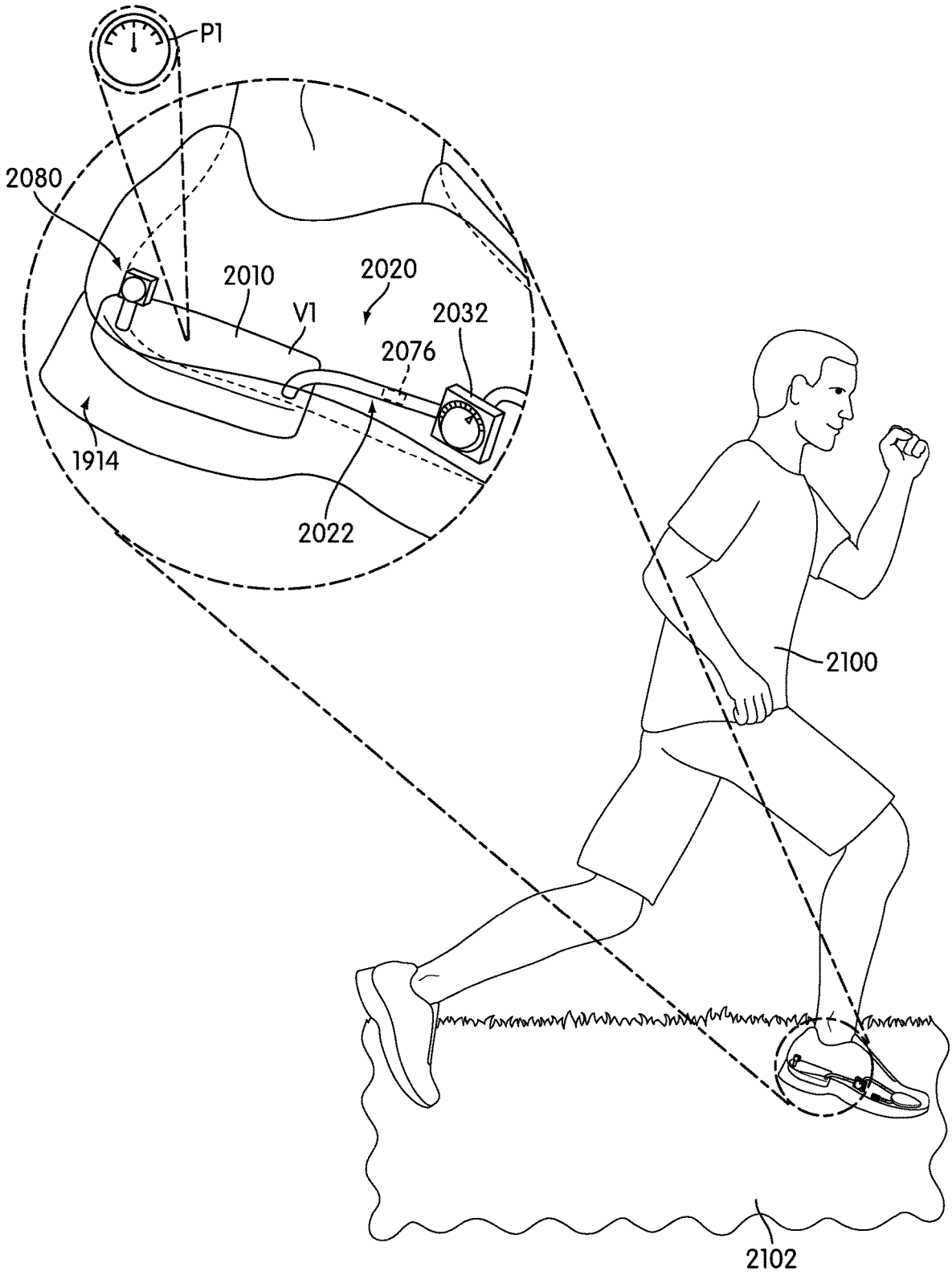
FIG. 23 is an isometric enlarged view of an embodiment of an article of footwear with an adaptive fluid system prior to contact with a ground surface.
Figure 24:
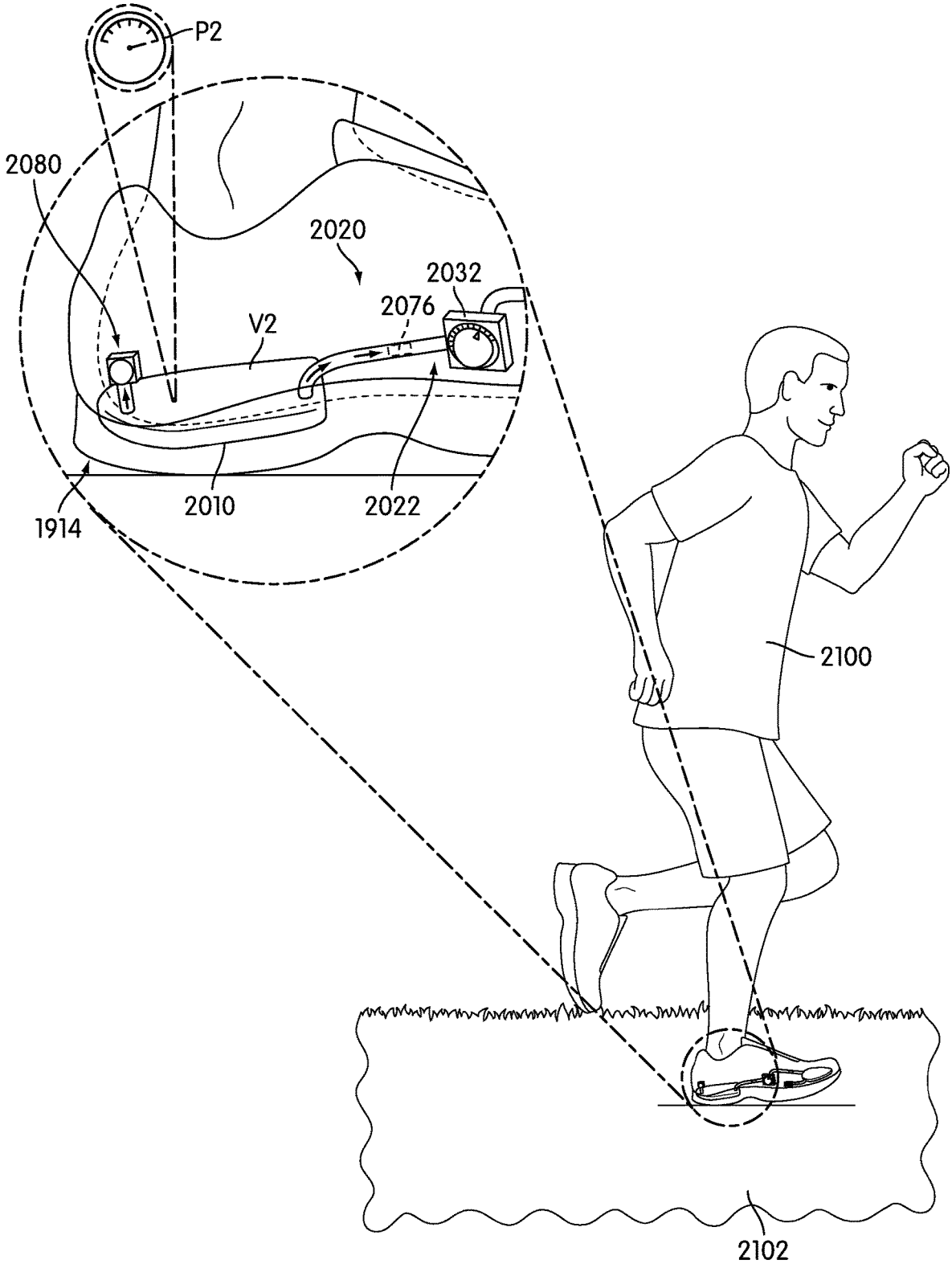
FIG. 24 is an isometric enlarged view of an embodiment of an article of footwear with an adaptive fluid system during contact with a ground surface.
Figure 25:
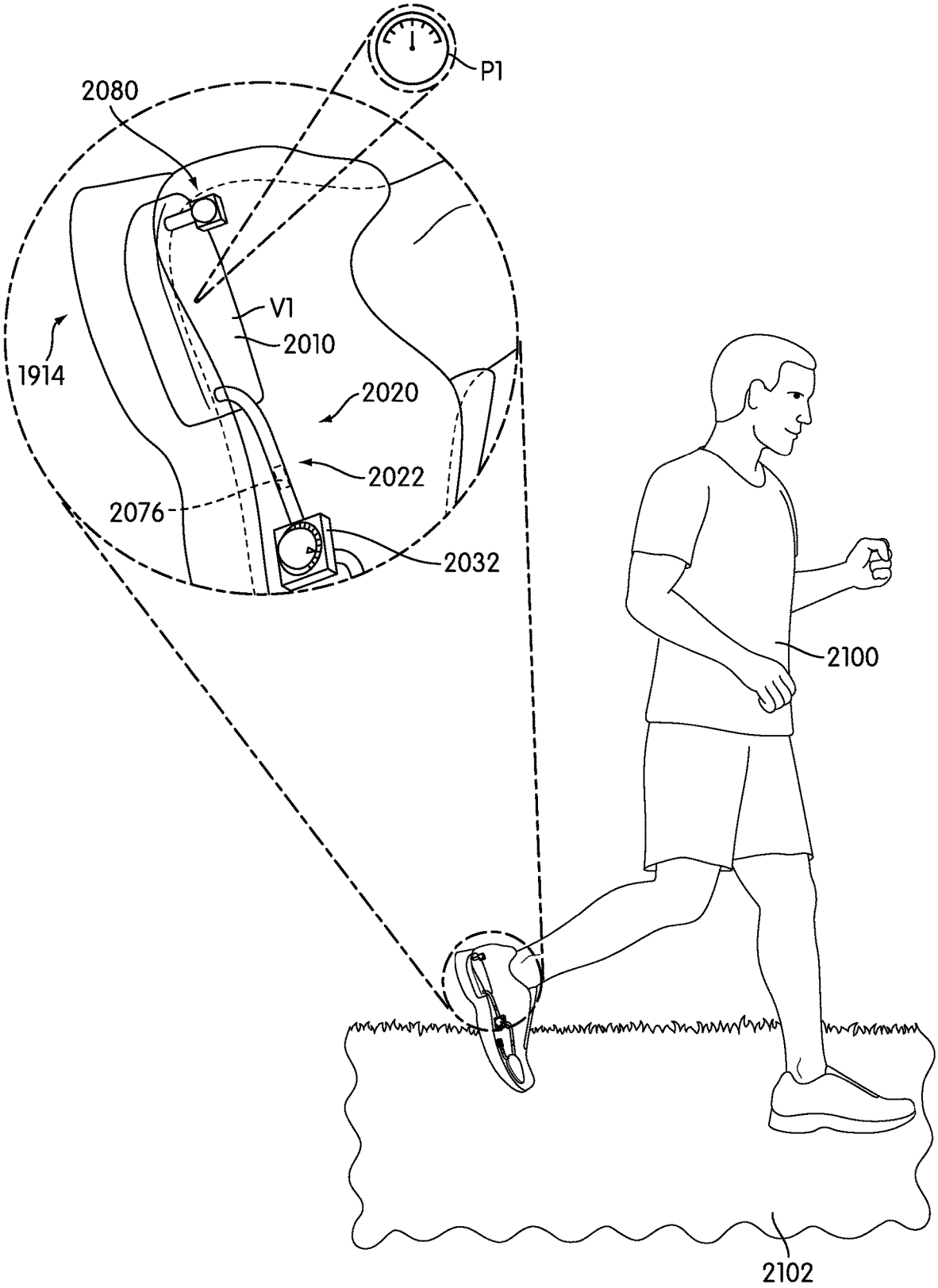
FIG. 25 is an isometric enlarged view of an embodiment of an article of footwear with an adaptive fluid system following contact with a ground surface.

FIGS. 23 through 25 illustrate an embodiment of adaptive fluid system 2020 in use. Referring to FIGS. 23 through 25, user 2100 may be running on ground surface 2102. Prior to an impact between heel portion 1914 of article 1900 and ground surface 2102, fluid chamber 2010 has volume V1 and pressure P1. In this case, pressure P1 may be associated with the maximum pressure setting of adjustable pressure regulating valve 2032. As heel portion 1914 impacts ground surface 2102, the volume of fluid chamber 2010 may momentarily compress to volume V2, which is slightly smaller than volume V1. As the volume decreases, the pressure momentarily increases to pressure P2, which is slightly larger than pressure P1. In this situation, fluid is unable to travel upstream through fluid line 2022 to adjustable pressure regulating valve 2032 due to the presence of third one way valve 2076. In addition, fluid cannot travel downstream through fluid line 2022 due to the presence of manual pressure release valve 2080, which is currently in a closed position. Therefore, as heel portion 1914 is raised from ground surface 2102, the volume and pressure of fluid chamber 2010 may be restored to the initial volume V1 and pressure P1, as seen in FIG. 25. Using this configuration the pressure within fluid chamber 2010 can be substantially continuously maintained to enhance the overall comfort for a user.

While various embodiments have been described, the description is intended to be exemplary, rather than limiting and it will be apparent to those of ordinary skill in the art that many more embodiments and implementations are possible. Accordingly, the embodiments not to be restricted except in light of the attached claims and their equivalents. Also, various modifications and changes may be made within the scope of the attached claims.

The invention claimed is:

1. An article of footwear comprising:

an upper;

a sole structure;

an intake valve having internal and external sides and being configured to receive fluid from an external pump;

an adjustable pressure regulating valve disposed on the article of footwear and having an adjustable pressure regulating valve inlet and an adjustable pressure regulating valve outlet, the adjustable pressure regulating valve being configurable to change a maximum pressure and to release fluid through the adjustable pressure regulating valve outlet when a fluid pressure at the adjustable pressure regulating valve inlet exceeds the maximum pressure;

a flow valve having a flow valve inlet and a flow valve outlet;

a fluid line having an internal region in fluid communication with the intake valve internal side, the adjustable pressure regulating valve inlet, and the flow valve inlet; and a fluid chamber located in the sole structure and in fluid communication with the flow valve outlet.

2. The article of footwear of claim 1, wherein the flow valve has an open position in which the flow valve inlet is in fluid communication with the flow valve outlet and closed position in which fluid communication between the flow valve inlet and the flow valve outlet is prevented.

3. The article of footwear of claim 1, wherein a portion of the adjustable pressure regulating valve is exposed on an outer portion of the article of footwear and is adjustable to change the maximum pressure setting.

4. The article of footwear of claim 1, wherein a portion of the flow valve is exposed on an outer portion of the article of footwear and is operable to open and close the flow valve.

5. The article of footwear of claim 1, wherein the adjustable pressure regulating valve, the intake valve, and the flow valve are located in the upper.

6. The article of footwear of claim 5, wherein the flow valve has an open position in which the flow valve inlet is in fluid communication with the flow valve outlet and closed position in which fluid communication between the flow valve inlet and the flow valve outlet is prevented, a portion of the adjustable pressure regulating valve is exposed on an outer portion of the article of footwear and is adjustable to change the maximum pressure setting, and a portion of the flow valve is exposed on an outer portion of the article of footwear and is operable to alternately place the flow valve into the open position or the closed position.

* * * * *